US010060138B2

(12) United States Patent
Farahmandpour

(10) Patent No.: US 10,060,138 B2
(45) Date of Patent: Aug. 28, 2018

(54) CLADDING TIE

(71) Applicant: Kamran Farahmandpour, Long Grove, IL (US)

(72) Inventor: Kamran Farahmandpour, Long Grove, IL (US)

( * ) Notice: Subject to any disclaimer, the term of this patent is extended or adjusted under 35 U.S.C. 154(b) by 0 days.

(21) Appl. No.: 15/916,532

(22) Filed: Mar. 9, 2018

(65) Prior Publication Data

US 2018/0202169 A1 Jul. 19, 2018

Related U.S. Application Data

(62) Division of application No. 15/165,904, filed on May 26, 2016, now Pat. No. 9,932,740.

(51) Int. Cl.

| | |
|---|---|
| ***E04F 13/08*** | (2006.01) |
| ***E04B 1/76*** | (2006.01) |
| ***E04B 1/41*** | (2006.01) |
| *E04F 13/14* | (2006.01) |
| *E04F 13/12* | (2006.01) |

(52) U.S. Cl.

CPC ..... *E04F 13/0853* (2013.01); *E04B 1/40* (2013.01); *E04B 1/4178* (2013.01); *E04B 1/7629* (2013.01); *E04F 13/0875* (2013.01); *E04F 13/086* (2013.01); *E04F 13/12* (2013.01); *E04F 13/14* (2013.01)

(58) Field of Classification Search

CPC ..... E04F 13/0862; E04F 13/24; E04F 13/26; E04F 13/0816; E04F 13/0801; E04B 1/4178; E04B 1/7616; E04B 1/7637; E04B 1/7629

See application file for complete search history.

(56) References Cited

U.S. PATENT DOCUMENTS

| | | | |
|---|---|---|---|
| 2,073,278 | A | 1/1936 | Hohl |
| 3,688,460 | A | 9/1972 | Van Loghem |
| 3,760,544 | A | 9/1973 | Hawes et al. |
| 4,067,155 | A | 1/1978 | Ruff |
| 4,222,210 | A | 9/1980 | Hanstein |
| 4,385,850 | A | 5/1983 | Bobath |
| 4,462,194 | A | 7/1984 | Wahner |
| 4,541,211 | A | 9/1985 | Garrett |
| 4,597,702 | A | 7/1986 | Brown |
| 4,707,894 | A | 11/1987 | Friedwald |
| 4,858,408 | A | 8/1989 | Dunn |
| 5,207,043 | A | 5/1993 | McGee et al. |
| 5,299,403 | A | 4/1994 | Fentz |

(Continued)

FOREIGN PATENT DOCUMENTS

| | | |
|---|---|---|
| EP | 0854245 B1 | 11/2001 |
| GB | 2069564 | 8/1981 |

*Primary Examiner* — Gisele D Ford

(74) *Attorney, Agent, or Firm* — Erickson Law Group, PC

(57) ABSTRACT

A cladding tie for providing a support connection between cladding and a vertical backup wall is disclosed. The tie has a base and a retainer assembly. The base has a shaft extending from a back plate. The retainer assembly has a retainer member, and a cladding connection member. The retainer member has a cladding connection member recess. The cladding connection member is movable relative to the retainer to permit differential movement between the cladding connection member and the retainer when the cladding connection member is connected to the retainer.

22 Claims, 15 Drawing Sheets

(56) References Cited

U.S. PATENT DOCUMENTS

| | | | |
|---|---|---|---|
| 5,426,905 | A | 6/1995 | Rollhauser et al. |
| 5,549,266 | A | 8/1996 | Mitchell et al. |
| 5,611,184 | A | 3/1997 | Felix |
| 5,611,185 | A | 3/1997 | Wilz |
| 5,634,310 | A | 6/1997 | Hohmann |
| 5,660,015 | A | 8/1997 | Kluser |
| 5,671,576 | A | 9/1997 | Kluser |
| 5,675,942 | A | 10/1997 | Crawford |
| 5,678,383 | A | 10/1997 | Danielewicz |
| 5,987,830 | A | 9/1999 | Garrett |
| 6,131,360 | A | 10/2000 | Dalen |
| 6,212,841 | B1 | 4/2001 | Digirolamo et al. |
| 6,263,631 | B1 | 7/2001 | Nisbett et al. |
| 6,314,694 | B1 | 11/2001 | Cooper |
| 6,347,435 | B1 | 2/2002 | Davignon |
| 6,588,165 | B1 | 7/2003 | Wright |
| 6,609,340 | B2 | 8/2003 | Moore, Jr. et al. |
| 6,711,870 | B1 | 3/2004 | Richardson |
| 7,059,577 | B1 | 6/2006 | Burgett |
| 7,225,590 | B1 | 6/2007 | diGirolamo |
| 7,415,803 | B2 | 8/2008 | Bronner |
| D614,941 | S | 5/2010 | Murphy |
| 7,818,935 | B2 | 10/2010 | Velickovic |
| 7,845,120 | B2 | 12/2010 | Thome |
| 8,161,705 | B2 | 4/2012 | Pratt |
| 8,555,595 | B2 | 10/2013 | Hatzinikolas |
| 8,567,145 | B1 | 10/2013 | Chauncey |
| 8,646,237 | B1 | 2/2014 | Takagi |
| 8,789,339 | B2 | 7/2014 | Scola |
| 9,010,064 | B1 | 4/2015 | Farahmandpour |
| 9,834,941 | B1 * | 12/2017 | Bilge ..... E04F 13/24 |
| 9,856,655 | B2 * | 1/2018 | Knight ..... E04F 13/0862 |
| 9,903,123 | B1 * | 2/2018 | Simonsen ..... E04F 13/0814 |
| 2003/0070379 | A1 | 4/2003 | Worley |
| 2006/0179762 | A1 | 8/2006 | Thome |
| 2006/0185319 | A1 | 8/2006 | Kufner et al. |
| 2007/0068707 | A1 | 3/2007 | Weir |
| 2007/0227086 | A1 | 10/2007 | Beavers et al. |
| 2008/0115439 | A1 | 8/2008 | Tamlyn |
| 2008/0184538 | A1 | 8/2008 | Shellnutt |
| 2010/0263304 | A1 | 10/2010 | Torrents I Comas |
| 2012/0085066 | A1 | 4/2012 | Kufner et al. |
| 2012/0317909 | A1 | 12/2012 | MacKenzie |
| 2013/0333163 | A1 | 12/2013 | Chen |
| 2014/0311071 | A1 | 10/2014 | Curtis |

* cited by examiner

Fig. 16
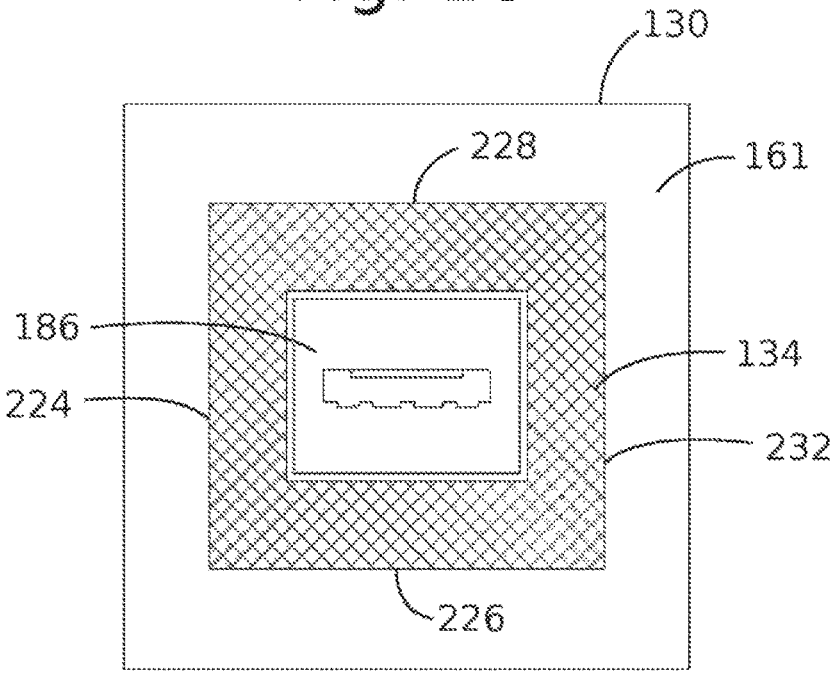
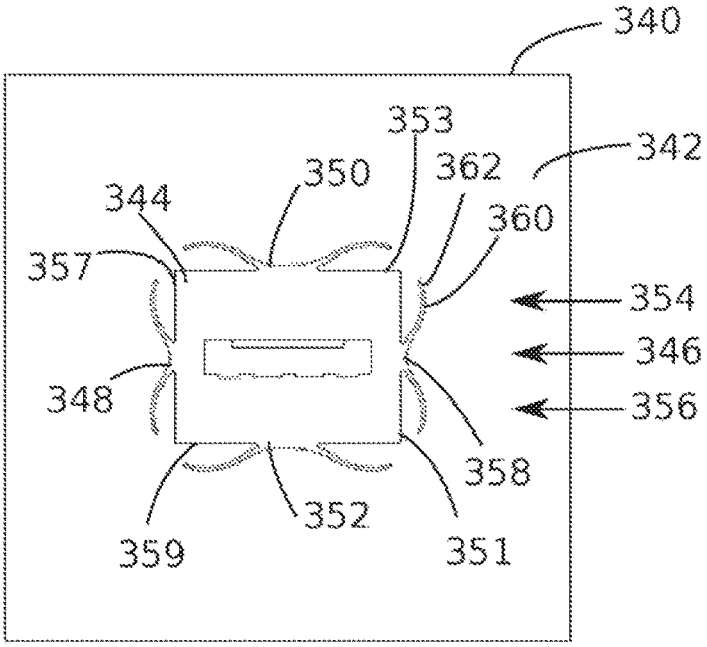
Fig. 17

CLADDING TIE

This application is a divisional of U.S. patent application Ser. No. 15/165,904, filed May 26, 2016, which is herein incorporated by reference.

FIELD OF THE INVENTION

This invention relates in general to cladding ties.

BACKGROUND OF THE INVENTION

The use of continuous insulation is mandated for some climates in the United States by newer energy codes. The purpose of continuous insulation is to eliminate thermal breaks that reduce thermal efficiency of insulation placed between framing members such as wall studs.

One efficient and technically sound exterior wall assembly that can function in all climates without any theoretical potential for condensation is a wall assembly in which rigid insulation boards or foam are placed outside of an air barrier (AB)/weather-resistive barrier (WRB) (i.e., within the wall drainage cavity). Such a wall assembly is often referred to as a "work everywhere wall." The use of continuous insulation in such a wall assembly requires the use of frequently placed conventional ties to connect the wall cladding (i.e., paneling, masonry, or other types of cladding) to the backup wall. The function of these ties is to transfer lateral loads such as wind loads from the cladding to the back-up wall which acts as the structural support for the cladding.

In most masonry assemblies, metal masonry ties need to be installed at 16 inches on center in horizontal and vertical directions to meet building code requirements. These metal ties pass through the continuous insulation and result in thermal breaks that reduce the efficiency of the continuous insulation.

Many commercially available metal ties are made using galvanized steel. When such ties are integrated into the wall assembly, they cannot be replaced without removal of the masonry veneer. The life expectancy of masonry veneer is anticipated to be more than 70 years. During the life cycle of steel masonry ties, they are exposed to the environment within the wall cavity which is constantly moist. This environment and damage to the galvanizing layer caused during installation can cause corrosion of the metal ties. In some cases, structural collapse of the masonry veneer due to corrosion of metal ties has been documented.

When using continuous insulation, the differential temperature between the cladding materials and the back-up wall construction is increased. This temperature differential, along with other factors such as moisture related volume changes, can lead to significant in-plane differential movements between the cladding material and the back-up construction.

The present inventor recognized the need for an improved cladding tie that reduces thermal bridging where the ties penetrate the continuous insulation. The present inventor recognized the need for an improved cladding tie that is less susceptible to deterioration by moisture and weather conditions.

Cladding can move differentially from a back-up wall due to a number of reasons, such as thermal movements, movements caused by moisture expansion of cladding, differential structural movements between the back-up wall and the cladding wall, and seismic movements. The present inventor recognized the need for a cladding attachment device that can accommodate in-plane differential movements between the cladding material and the back-up wall construction.

The present inventor recognized the need for a cladding attachment device that would be easy to install. The present inventor recognized the need for a cladding attachment device that can be efficiently installed in such a manner that the accommodated in-plane differential movements can be in any in-plane direction without a need to set a starting point of movement in the attachment device.

When installing continuous insulation panels, the panels are often installed in complete contact with the AB/WRB on the back-up surface. This prevents proper drainage of water on the exterior face of the AB/WRB. Water can be trapped in the minute gap between the continuous insulation and AB/WRB due to capillary action. This trapped water can cause accelerated deterioration of ties and other components.

The present inventor recognized the need for an improved cladding tie that creates a gap between the continuous insulation panels and AB/WRB. This gap facilitates drainage.

Conventional cladding ties do not provide any mechanism for ensuring that the continuous insulation panels are held in place. As such, continuous insulation panels are often installed with adhesive backing to ensure they stay in place. This adhesive backing can impede drainage of water on the drainage plane and can degrade and fail over time under certain circumstances. This adhesive backing will also results in additional labor and material costs.

The present inventor recognized the need for a cladding tie that can retain the continuous insulation panels in place and eliminate the need of reliance on adhesive backing.

Certain building codes restrict the length of conventional metal ties to 4 inches because longer length conventional ties are susceptible to buckling under compressive load. The present inventor recognized the need to transfer some compressive force from the cladding tie onto the insulation to reduce or eliminate the possibility of buckling under compressive loads and to reduce the effective span of the tie shaft within the cavity.

SUMMARY OF THE INVENTION

A cladding tie for providing a support connection between a cladding wall and a backup wall is disclosed. The cladding tie comprises a base and a retainer assembly.

In some embodiments, the cladding tie permits differential in-plane movement between the cladding wall and the backup wall. Any movement in-plane is allowed within a predefined range.

In one embodiment, the retainer assembly comprises a cladding connection member, a retainer member. The base comprises a shaft and a back plate. The shaft extends from the back plate. The shaft comprises a plurality of teeth. The cladding connection member comprises a cladding attachment surface and a retainer connection portion.

The retainer member comprises an insulation contact surface, a receiving channel, a cladding connection member recess, and a locking arm. The receiving channel comprises a receiving entrance on the insulation contact surface. The receiving channel extends transversely through the insulation contact surface and is configured to receive the shaft. The locking arm is adjacent the receiving channel. The locking arm is biased to a locked position where the locking arm engages at least one of the plurality of shaft teeth when the at least one of the plurality of shaft teeth is adjacent the locking arm to prevent the retainer member from moving in a first direction away from the back plate.

The retainer connection portion is moveable within the cladding connection member recess to permit differential movement between the cladding connection member and the retainer when the cladding connection member is connected to the retainer.

The retainer member is configured to hold an insulation panel against the back plate when the retainer member in a holding position along the shaft.

In some embodiments, a resilient biasing member is provided. The biasing member is located in the cladding connection member recess to buffer contact between the cladding connection member and the retainer. The biasing member also biases the cladding connection member a centered position. This centering feature ensures that the ability of the cladding tie to allow differential in-plane movements is maintained in all directions after installation.

In some embodiments, the cladding connection member comprises a cladding engagement portion and a retainer engagement portion. The cladding engagement portion comprises a plurality of corrugations for interlocking with mortar of a masonry join of the vertical cladding wall. The retainer engagement portion is moveable within the cladding connection member recess to permit differential movement between the cladding connection member and the retainer when the cladding connection member is connected to the retainer.

Numerous other advantages and features of the present invention will become readily apparent from the following detailed description of the invention and the embodiments thereof, from the claims, and from the accompanying drawings.

BRIEF DESCRIPTION OF THE DRAWINGS

FIG. 16 is a rear view of the retainer member and the spacer of the cladding tie of FIG. 1.

FIG. 17 is a rear view of an alternate embodiment retainer member.

DETAILED DESCRIPTION

Figure 1:
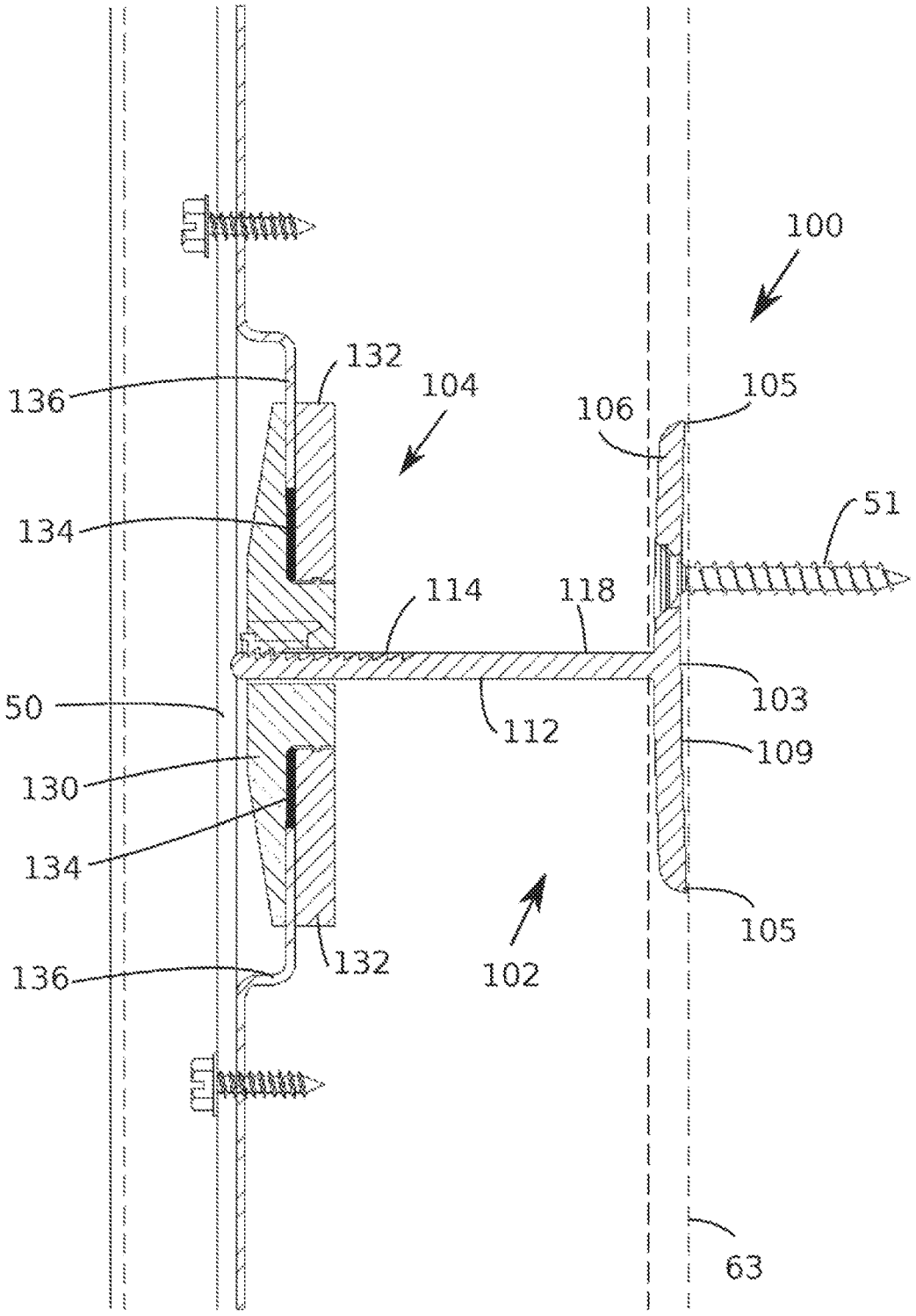
FIG. 1 is a side sectional view of a first embodiment of a cladding tie of the invention taken along the line 1-1 of FIG. 10.

The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIGS. 1 through 10 show a first embodiment cladding tie 100. The tie 100 comprises a base 102 and a retainer assembly 104. In some embodiments, both the base and retainer assembly are manufactured using or comprising a semi-rigid plastic material.

Figure 8:
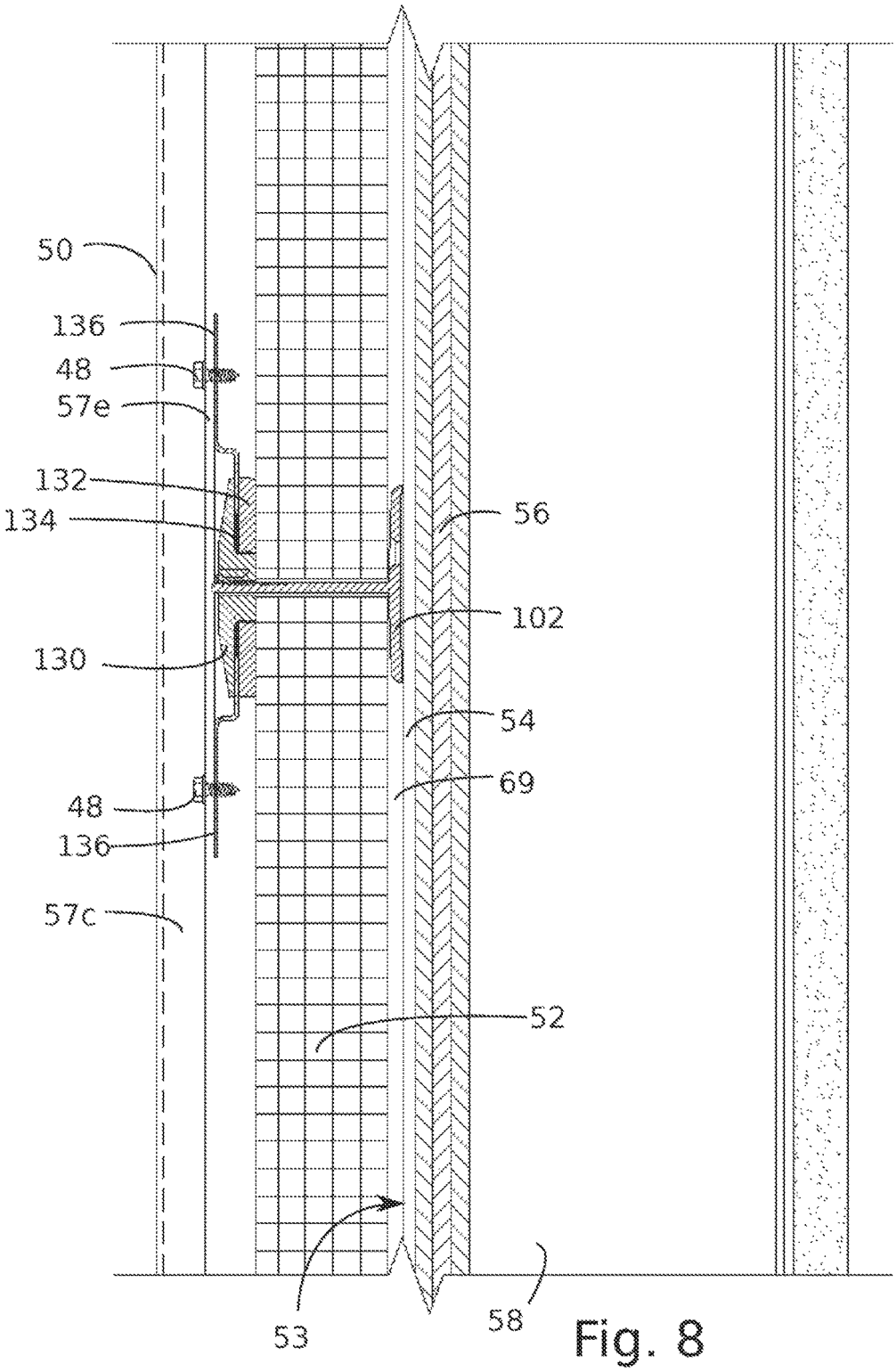
FIG. 8 is a side section view of cladding tie of FIG. 1 shown in a first application.
Figure 9:
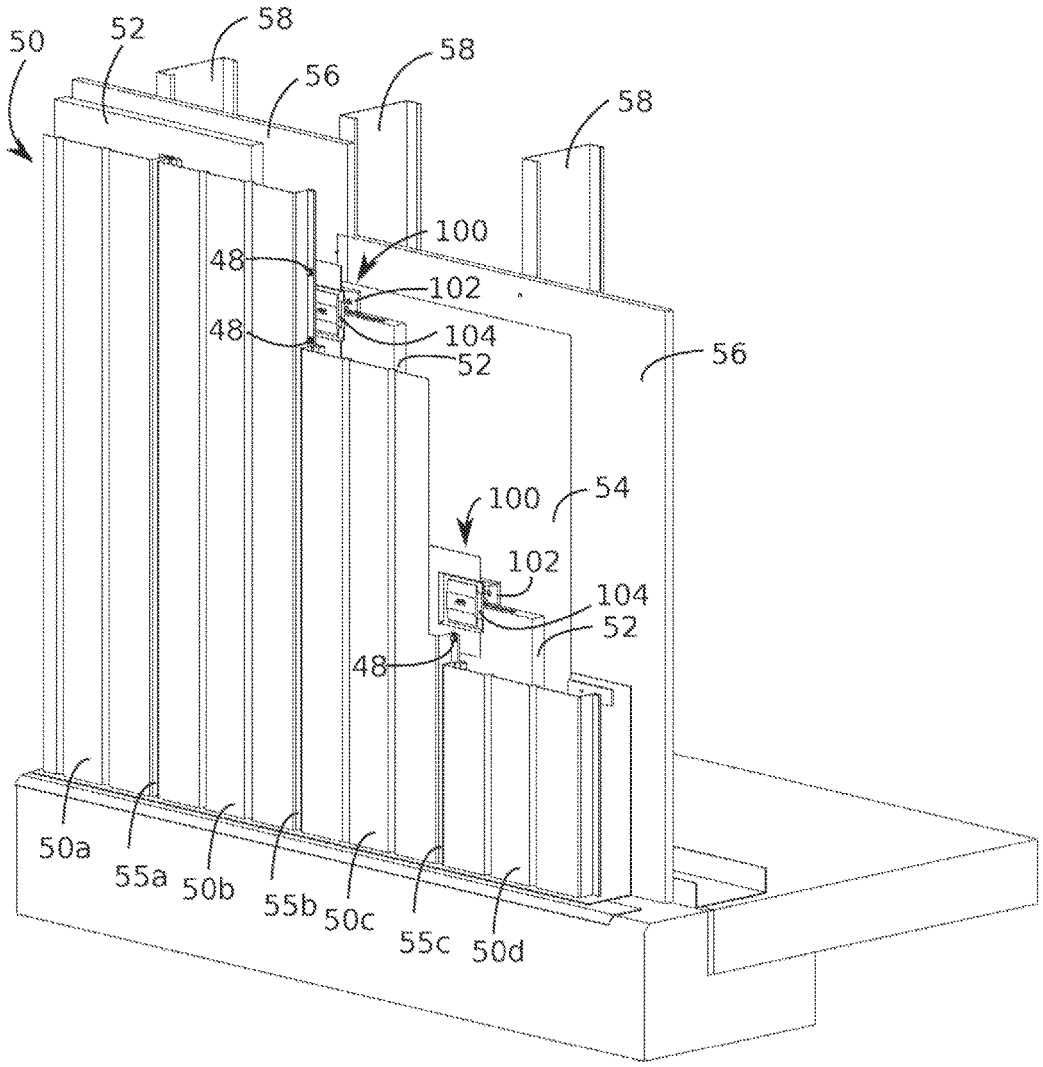
FIG. 9 is a perspective view of the cladding tie in the first application of FIG. 8 with certain components of a cladding and a backup wall partially cut away.
Figure 10:
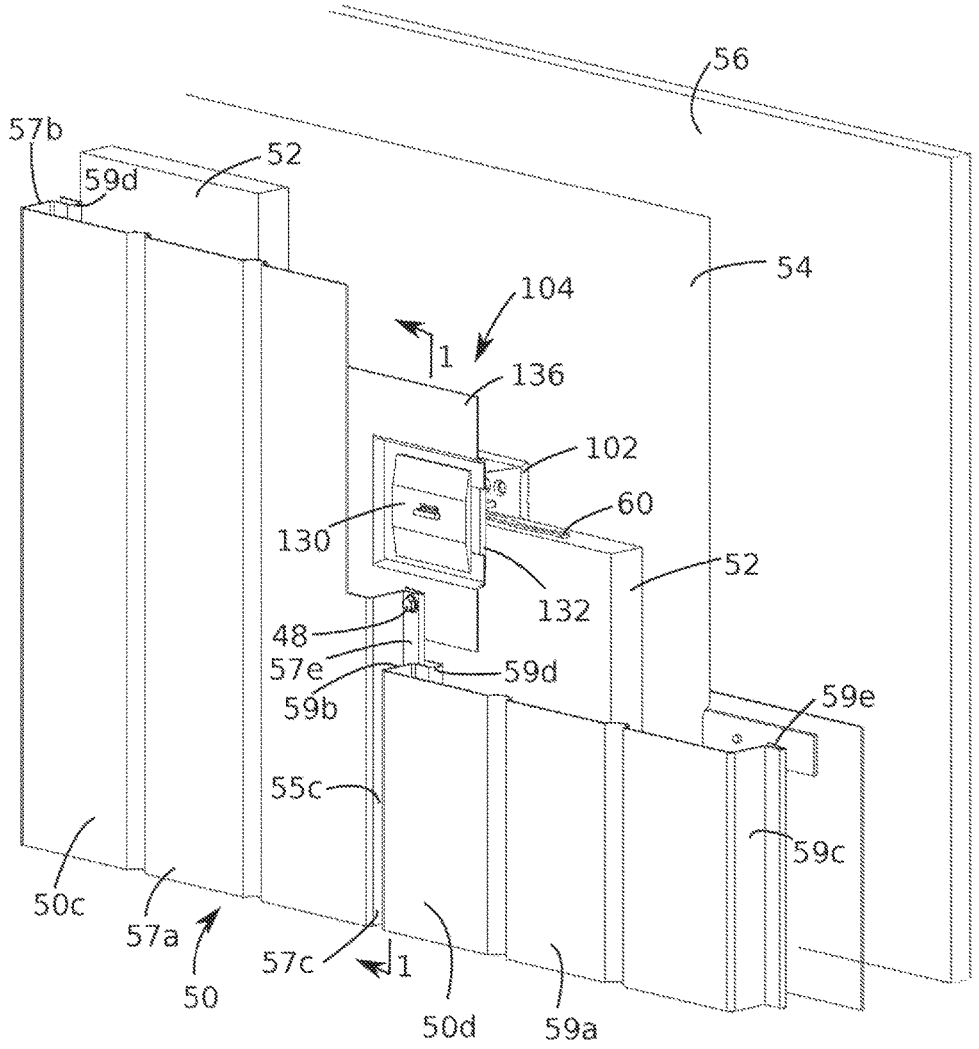
FIG. 10 is an enlarged perspective view of the cladding tie shown in the first application of FIG. 9.

FIGS. 8 through 10 show the cladding tie 100 deployed in a first application. The base is attached to a backup wall 53. In some embodiments, the backup wall 53 may have an air barrier (AB) and/or weather-resistant barrier (WRB) 54, placed over an exterior wall board 56, placed over wall studs 58. In some applications, the base may be attached over the air barrier and/or weather-resistant barrier 54. The base may be used on other walls or backup wall arrangements known in the art.

The base 102 has a back plate 106 and a shaft 112 extending from the back plate. In some embodiments, the shaft extends perpendicular from the back plate. The shaft 112 has a blank portion 118, a toothed section 114, and an end portion 120. The blank portion 118 is adjacent the back plate 106.

Adjacent the blank portion 118 opposite the back plate is the toothed section 114. The length of the blank portion 118 may depend on the desire thickness of the insulation panels 52 of a given application. The toothed section 114 has a plurality of shaft teeth 113 adjacent recesses 113*c*. On opposite lateral sides of the toothed section are shoulders 116. The shoulders 116 provide improved rigidity in the vertical direction in resistance against buckling under compressive load. In addition, the shoulders 116 assist in alignment when the shaft is inserted in a receiving channel 142 of a retainer member 130 of the retainer assembly 104.

Figure 7:
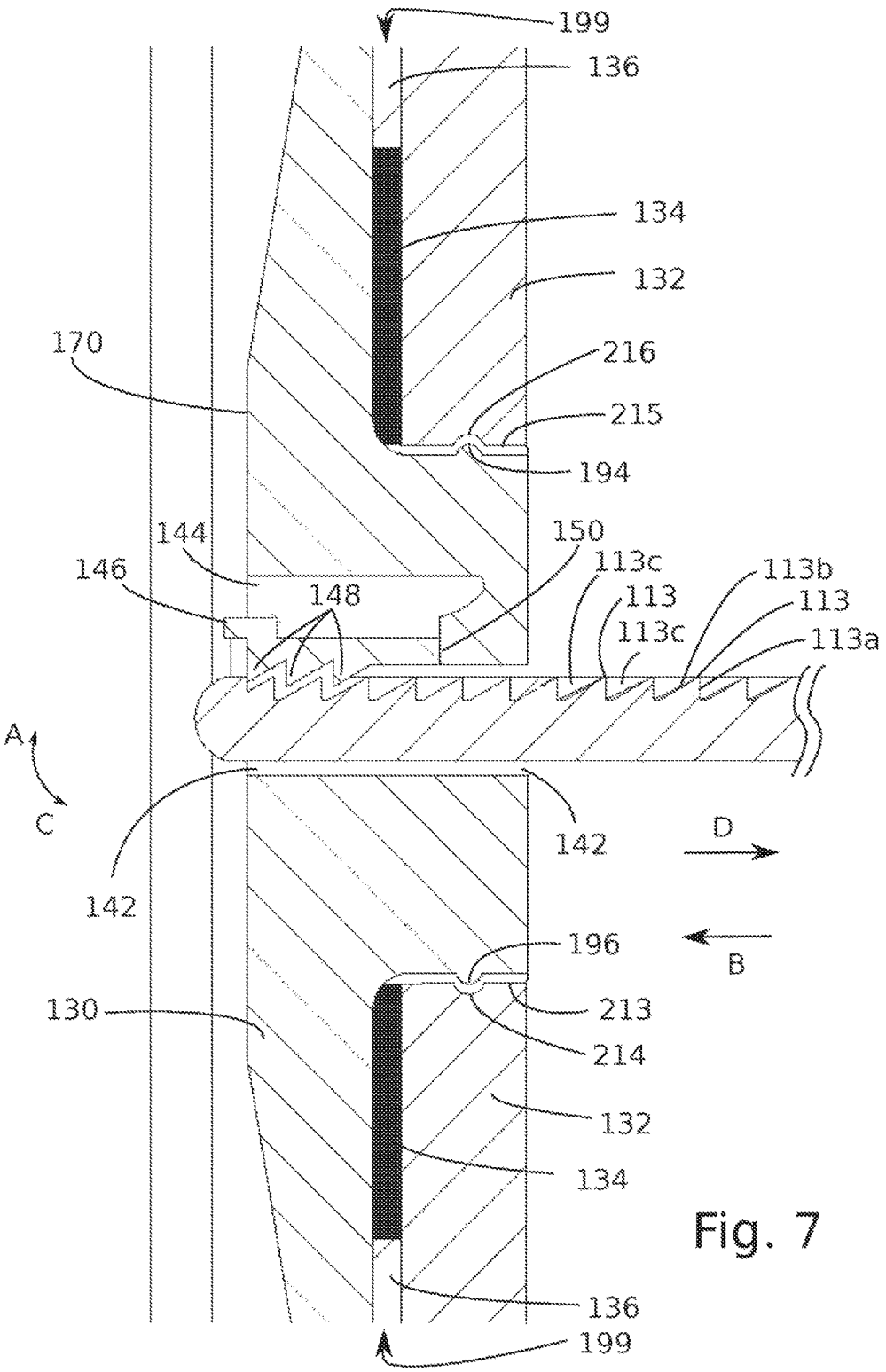
FIG. 7 is an enlarged side sectional view of the cladding tie of FIG. 1.

The teeth 113 comprise a vertical raised portion 113*a* intersecting an angled second portion 113*b* to form a peek as can best be seen from FIG. 7. In some embodiments, the toothed portion comprises anywhere between 40% and 80% or more of the length of the shaft.

Adjacent the toothed section 114 opposite the blank portion 118 on the shaft is the end portion 120. The end portion 120 may comprise tapered sides 120*a* (right side not shown). The tapered arrangement allows for easier insertion into the receiving channel 142 of the retainer member.

Figure 2:
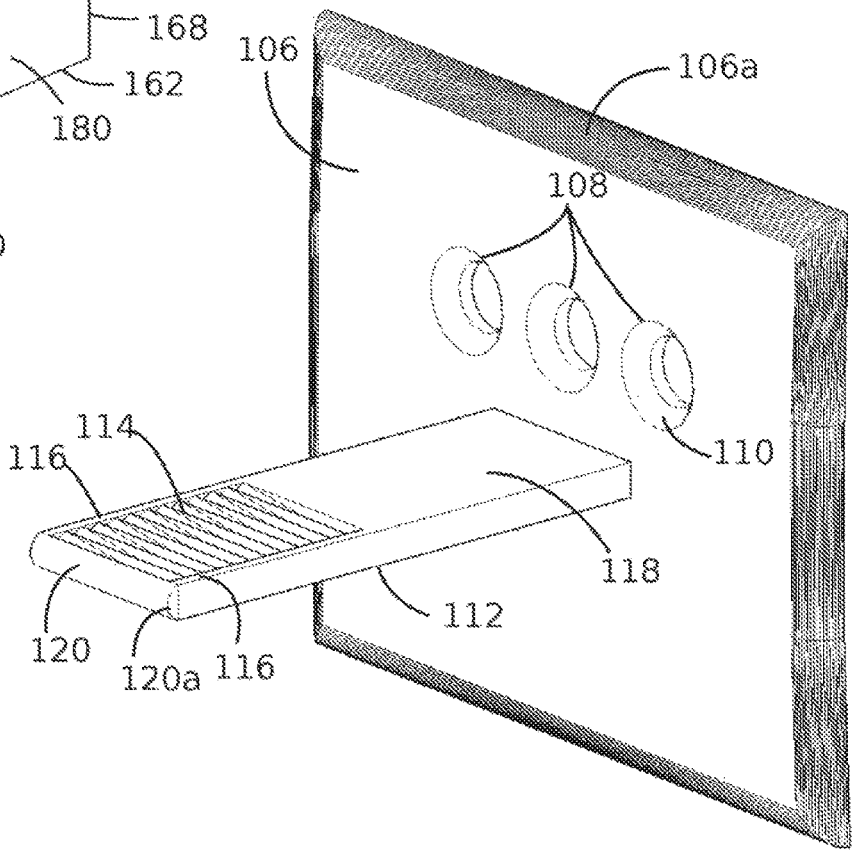
FIG. 2 is a perspective view of a base of the cladding tie of FIG. 1.
Figure 4:
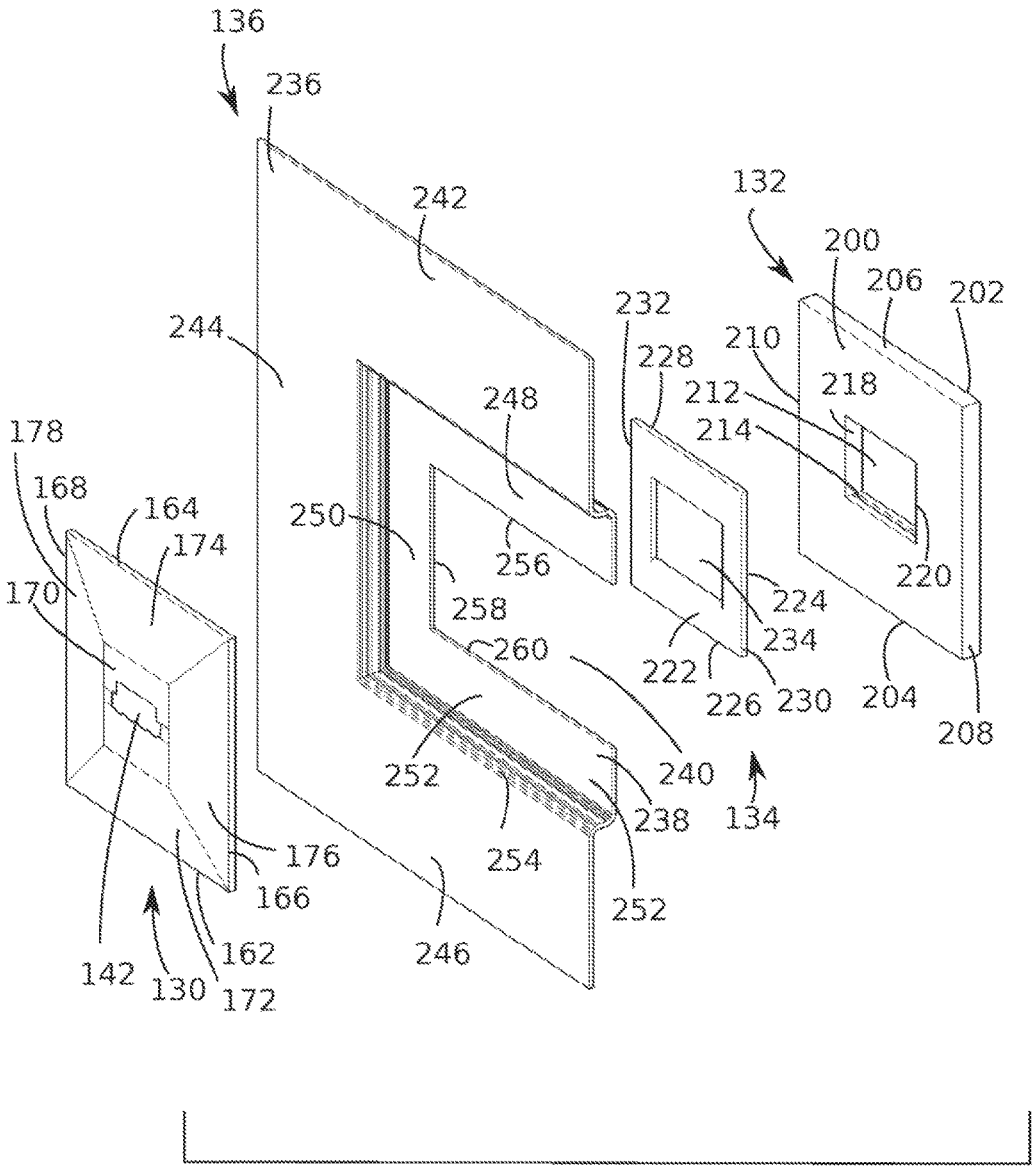
FIG. 4 is an exploded view of a retainer assembly of the cladding tie of FIG. 1.
Figure 5:
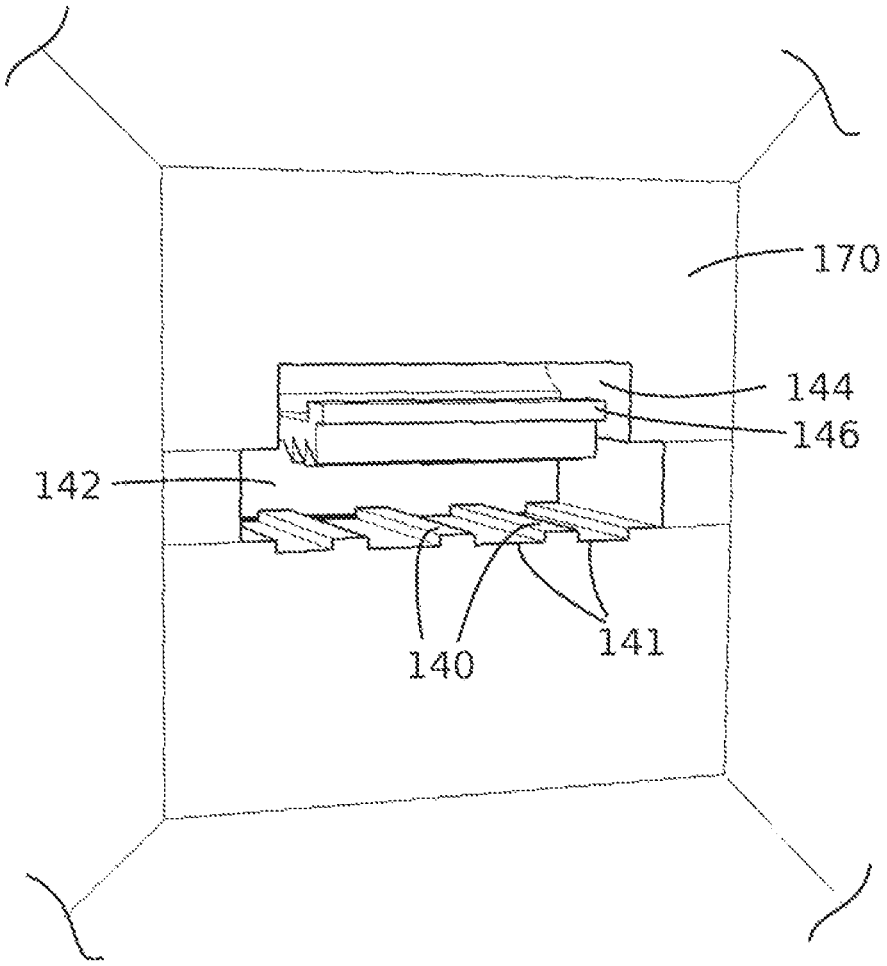
FIG. 5 is an enlarged front perspective view of a front portion of the retainer member of the cladding tie of FIG. 1.

The back plate 106 comprises one or more fastening apertures 108. Multiple fastening apertures allow for increased variably in alignment with studs of the back-up wall. The fastening apertures may comprise countersunk recesses 110 is shown in FIG. 2. In one embodiment, the apertures are located above the shaft and are centered laterally over the shaft. Screws 51 or other fasteners may be inserted into and through the fastening apertures to secure the base to an exterior surface, such as the backup wall 53. The base may comprise an amount of pre-applied mastic or sealant at the fastening apertures to help seal the air barrier and/or weather-resistant barrier 54 at the point of fastener penetration. Fastener apertures may be located in other locations other than those shown in FIG. 2 and may be provided in more or less than the three apertures as shown.

The back plate has a back surface 109. In some embodiments, the back surface may be concave. The concave arrangement provides that the entire perimeter 105, from the top, bottom, left, and right edges, of the back surface 109 is located closer to the straight plane 63, such as might be provided by the backup wall 53, as compared to the center 103. Therefore, the back plate is continuously curved from the perimeter to the center 103. The back surface 109 is at least slightly concave. The concave or cupped arrangement provides for a more uniform pressure on the back-up wall surface when fastened to the back-up wall 53. This occurs because the pressure of the screws drawing the back plate against the backup wall surface causes the back surface 109 to flex and flatten against the backup wall surface. This can result in a more uniform pressure applied across the external surface, such as the backup wall surface, from the back plate.

The retainer assembly 104 comprises a retainer member 130, a rear plate 132, a spacer 134, and a cladding connection member or mount plate 136. The retainer member 130 comprises a receiving channel 142, a front face 160, a back side 161, a bottom side 162, a top side 164, a left side 166, and a right side 168.

The front face 160 comprises a central portion 170, a lower angled portion 172, an upper angled portion 174, a left side angled portion 176, and a right side angled portion 178. The angled portions 172, 174, 176, 178 are inclined from the respective sides 162, 164, 166, 168 to the central portion 170.

Figure 3:
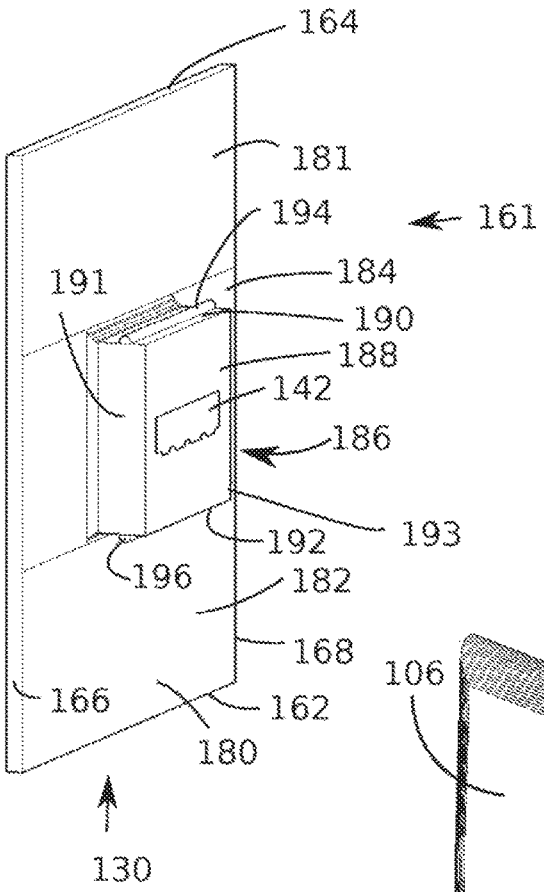
FIG. 3 is a rear perspective view of a retainer member of the cladding tie of FIG. 1.

The back side 161, as shown in FIG. 3, comprises a first back surface 180 and a protruding portion 186. The first back surface 180 comprises a top section 181, a bottom section 182, and a middle section 184. The protruding portion 186 is in the middle section 184. In some embodiments, the protruding portion 186 is spaced equidistant between the left side 166 and the right side 168. In some embodiments, the protruding portion 186 is equidistant from the bottom side 162 and the top side 164. In some embodiments, the top section 181, bottom section 182, and middle section 184 each represent a third of the back surface 180. In some embodiments, the protruding portion comprising a square, rectangle, quadrilateral, circle, ellipse or other shape.

The protruding portion 186 comprises a back surface 188, a top surface 190, a bottom surface 192, a left side surface 191, and a right side surface 193. The top surface 190 comprises a top elongated projection 194 extending along the top surface from the right side to the left side. The bottom surface 192 comprises a bottom elongated projection 196 extending along the bottom surface from the right side to the left side.

The channel 142 extends from the back surface 188 through the protruding portion and through the central portion 170 of the front face. The floor of the channel 142 comprises a plurality of raised portions or plateaus 140 and recesses 141.

The rear plate 132 comprises a front surface 200, a back surface 202, a bottom surface 204, a top surface 206, a left side 208, a right side 210, and a rear plate aperture 212. The aperture 212 comprises a lower surface 213 having a lower groove 214 and an upper surface 215 comprises an upper groove 216. The upper and lower grooves extend along the upper and lower surfaces, respectively, between the right and left sides 218, 220. In some embodiments, the exterior perimeter of the rear plate comprises a square, rectangle, quadrilateral, circle, ellipse or other shape.

The aperture 212 is sized so that the lower surface 213, upper surface 215, left side 220, and right side 218 are in surface-to-surface contact or in close proximity, as shown in FIG. 7, to bottom surface 192, top surface 190, left side surface 191, and right side surface of the protruding portion 186, respectively. The bottom elongated projection 196 is releaseably received in the lower grove 214 and the top elongated projection 194 is releaseably received in the upper groove 216 to maintain and secure the connection between the rear plate 132 and the retainer member 130.

The spacer 134 comprises a front surface 222, a back surface 224, a bottom surface 226, a top surface 228, a left side 230, a right side 232, and a spacer aperture 234. The interior walls defining the spacer aperture are sized so they are in surface to surface contact or in close proximity to the corresponding to bottom surface 192, top surface 190, left side surface 191, and right side surface of the protruding portion 186. In some embodiments, the spacer aperture 234 comprises an area that is the same as an area of the rear plate aperture 212.

The mount plate 136 comprises a cladding attachment portion 236, a retainer connection portion 238, and a receiving opening 240. The retainer connection portion 238 is recessed from the cladding attachment portion 236. A curved transition 254 is provided between the retainer connection portion 238 and the cladding attachment portion 236. The cladding attachment portion 236 comprises an upper portion 242, a side portion 244, and a lower portion 246. The retainer connection portion 238 comprises an upper portion 248, a side portion 250, and a lower portion 252. The receiving channel is open to the left side.

The retainer assembly 104 is joined and provided against insulation panels 52 as shown in FIGS. 1 and 8. The rear plate 132 is placed over the shaft 112 so that the shaft is received through the rear plate aperture 212. The rear plate may be placed against or adjacent the insulation panel 52. Then the spacer 134 is placed over the shaft 112 so that the shaft is received through the spacer aperture 234. The spacer may be placed against the front surface 200 of the rear plate 132. Then the retainer member 130 is placed over the shaft so that the shaft is received in the receiving channel 142. The spacer 134 and the rear plate 132 are placed over the protruding portion 186 so that the protruding portion 186 is received through the spacer aperture 234 and into the rear plate aperture 212. The grooves 214, 216 receive the elongated protrusions 194, 196. The retainer member 130, the spacer 134, and the rear plate 132 are moved together until the rear plate is against or adjacent the front surface of the insulation panel 52.

Alternatively, the spacer 134 and the rear plate 132 may first be placed over the protruding portion 186 so that the protruding portion 186 is received through the spacer aperture 234 and into the rear plate aperture 212. The sides of the spacer aperture 234 are in contact with the sides of the protruding portion 186 as shown in FIG. 16. In some embodiments, the spacer temporarily or permanently attached to the sides of the protruding portion. The grooves 214, 216 receive the elongated protrusions 194, 196. And then the retainer member, spacer, and rear plate, together as a unit, is placed over the shaft so that that the shaft is received in the receiving channel 142. And the retainer member, spacer, and rear plate, together as a unit, are moved adjacent to or in contact the insulation panel. A recess or slot 199 is formed between the back surface 180 of the retainer member and the front surface 200 of the rear plate for receiving the mount plate. The recess or slot 199 comprises the spacer 134, as is shown in FIG. 7.

Figure 6:
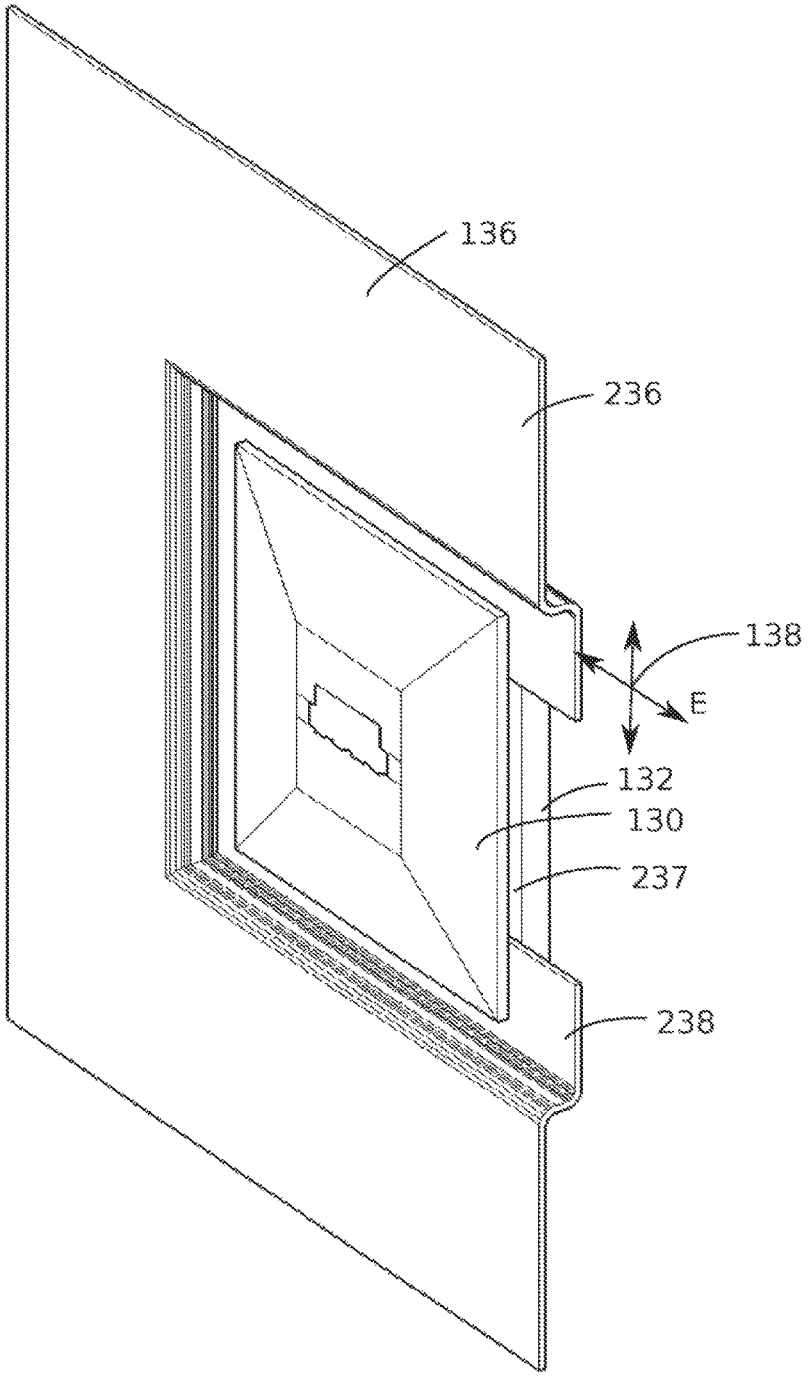
FIG. 6 is a perspective view of the retainer assembly of the cladding tie of FIG. 1.

The mount plate 136 is then moved over the spacer 134 and protruding portion 186 of the retainer member 130 in the direction E of FIG. 6 between the first back surface 180 of the retainer member 130 and the front surface 200 of the rear plate 132. The top surface 228, right side surface 232, and bottom surface 226 of the spacer are in contact or adjacent the respective corresponding top surface 256, right side surface 258, bottom surface 260 of the receiving opening. The front surface 222 contacts the back side 186 of the retainer member 130. The left side surface 224 is not in contact with the mount plate 136 due to the side opening provided by the a receiving opening 240. Therefore, there is a left side gap 237 between the retainer member 130 and the rear plate 132 adjacent the left side surface 224.

In some embodiments, the spacer 134 comprises a flexible material, such as foam. The flexible material may be resilient, elastic, or otherwise returnable to a default expanded state after being compressed when not under a load above a predefined threshold. The flexible material of the spacer automatically self-centers the mount plate 136 about the spacer and protruding portion 186 during installation. This allows ease of installation in that the installer does not need to center the mount plate relative to the protruding portion, instead the installer places the mount plate in contact with or adjacent to the top surface 228, right side surface 232, and bottom surface 226 of the spacer. The spacer will appropriately position the mount plate relative to the protruding portion, the retainer member, and thereby relative to the shaft when the retainer member is mounted to the shaft. This centering feature ensures that the ability of the cladding tie to allow differential in-plane movements is allowed in all directions after installation.

Movement parallel to the cladding wall 50 or 326 or the front surface of cladding wall 50 or 326 is allowed by the slot 199. For example, movement of the mount plate 136 in one or more directions parallel to the cladding is allowed within the slot 199, which can permit differential movements between the cladding and backup wall.

The plane(s) of "in-plane" refer to any plane parallel to the cladding wall, such as the cladding wall 50 or 326 or the front surface of cladding wall 50 or 326. The slot 199 is parallel to the cladding 50 when deployed. Therefore in-plane movement is allowed within the plane of the slot 199. The slot 199 is sized to receive the retainer connection portion 238. The retainer connection portion 238 and the cladding attachment portion 236 of the mount plate 136 are each parallel to the cladding 50 when deployed. Therefore, in-plane movement is allowed within the plane of retainer connection portion 238 and the plane of the cladding attachment portion 236 when the retainer connection portion 238 is received in the slot 199. Further, a vertical arm 280 of a second embodiment cladding connection member 278 is parallel to the cladding 326 when deployed. The slot 199 is sized to receive the vertical arm 280 of the second embodiment cladding connection member 278. Therefore, in-plane movement is allowed in the plane of the vertical arm 280 when the vertical arm 280 is received in the slot 199.

Four directions, two vertical directions and two horizontal directions, of in-plane movement or movement parallel to the cladding are illustrated at the compass rose 138 in FIG. 6. Any intermediate direction of in-plane movement, between the four directions illustrated, is also possible. Therefore, any combination of vertical and horizontal movement is possible parallel to the cladding, for example, in the slot 199 or the plane of retainer connection portion 238. In some embodiments, the back plate 106 and the backup wall 53 are each parallel to the cladding 50 or 326 or the front surface of cladding wall 50 or 326. In some embodiments, the backup wall 53 and the back plate 106, such as when mounted to the backup wall, are each parallel to the cladding 50 or 326 or the front surface of cladding wall 50 or 326. In some embodiments, the first back surface 180 of the retainer, the back surface 188 of the protruding portion 186, and the back surface 202 of the rear plate, and the front face 160 of the central portion 170, are each parallel to the he cladding 50 or 326 or the front surface of cladding wall 50 or 326.

The flexibility or collapsibility of the spacer allows movement of the mount plate 136 relative to the shaft 112, the retainer member 130, the rear plate 132, and the spacer 134 in any in-plane direction, such as, in the plane of the slot 199. Likewise, the flexibility of the spacer allows movement of the shaft 112, the retainer member 130, the rear plate 132, and the spacer 134 relative to the mount plate 136 in any in-plane direction, such as, in the plane of the slot 199.

Pressure from the mount plate or pressure between the mount plate and the protruding portion 186 can compress or crush one or more sides of the spacer to allow in-plane movement. Likewise, pressure transferred via the shaft and retainer can cause the one or more sides of the spacer to be compressed or crushed against the mount plate or between the mount plate and the protruding portion 186. The in-plane movement allowance enabled by the spacer permits differential movement between the cladding 50 and the backup wall 53 without destruction or impartment of the cladding tie, or cracking of the cladding material, while allowing transfer of wind load in the out-of-plane direction from the cladding through the shaft and base to the backup wall. Any movement in-plane is allowed within a predefined range. In one example, the predefined range of movement in a given in-plane direction is defined or limited by the extent and distance that the spacer can be compressed or crushed between the mount plate and the protruding portion 186.

Sections 181, 184, 182 of the back side 186 of the retainer member 130 contact the front surfaces of portions 248, 250, and 252, respectively, of the retainer connection portion 238 of the mount plate 136. Rear surfaces of portions 248, 250, and 252 contact the front surface 200 of the rear plate 132. The back surface 202 of the rear plate 132 contacts the front surface of the insulation panel 52.

Then the retainer member can be moved further in the direction D to increase compression on the insulation panel and the mount plate 136. In some embodiments and applications, the retainer member 130 provides a friction or compression grip on the mount plate 136 by pressure between the retainer member 130 and the rear plate 132 through the insulation panel and the back plate 106. The friction or compression grip prevents the mount plate 136 from becoming disconnected from the retainer assembly 104.

In some embodiments and applications, grip of the retainer on the mount plate 136 does not prevent the in-plane movement at the retainer connection portion 238 of the mount plate 136, explained above, to allow for in-plane differential movement of the cladding wall 50 relative to the backup wall and the shaft. In some embodiments, the retainer does not grip the mount plate 136, so as to allow in-plane movement of the mount plate 136. In some embodiments, the retainer and the rear plate are each adjacent or in surface-to-surface contact with the mount plate at the slot 199 to guide the in-plane movement of the mount plate and limit the movement of the mount plate to in-plane movements between the retainer and the rear plate in the slot 199.

In some embodiments, the spacer comprises a thickness that is the same, less than, or greater than the thickness of the retainer connection portion 238 of the mount plate 136. The receiving channel 142 of the retainer member 130 is configured, as shown in FIG. 1, to receive the shaft 112 there through. Adjacent the receiving channel 142 is a locking arm 146 with locking arm teeth 148 which together with the shaft teeth create a ratcheting mechanism to secure the retainer assembly 104 movement in the direction B of FIG. 7. The locking arm can be provided with one, two, three or more than two locking arm teeth 148. In some embodiments, the locking arm protrudes beyond the front surface of the central portion 170 as shown in FIG. 7.

The locking arm 146 is biased to extend into the receiving channel 142 in the direction C of FIG. 7. When the shaft 112 is inserted into the receiving channel 142 at least the teeth 148 engage with the shaft and the shaft drives the locking arm 146 about pivot location 150 in the direction A of FIG. 7. The locking arm comprises downward extending locking arm teeth 148. The locking arm teeth 148 engage with the shaft teeth 113. The engagement between the teeth 148 and teeth 113 prevent the retainer member 130 and assembly 104 from moving away from the base in the direction B shown in FIG. 7.

The locking arm teeth 148 can be disengaged from the shaft teeth 113 by pulling the locking arm 146 upward in the direction A of FIG. 7 into an upper area 144. When the locking arm teeth 148 are disengaged from the shaft teeth 113, the retainer member 130 can be removed in the direction B.

The locking arm 146 does not need to be raised, to disengage the locking arm teeth 148 from the shaft teeth 113, in order to allow the retainer member 130 and retainer assembly 104 to move in direction D relative to the shaft. When the retainer member 130 is moved in direction D relative to the shaft 112, angled portions of the teeth 148 will slide along the angled second portions 113*b* of the shaft teeth 113 from one tooth to the next until the retainer member is no longer moved in direction B or the retainer member 130 and rear plate 132 meet an exterior surface, such as continuous insulation panels 52. In this way, the retainer member 130 can secure the continuous insulation panels 52 against the backup wall 53 and or the back plate 106 at least until the locking arm is moved in the direction A to release the locking arm teeth 148 from the shaft teeth 113. Therefore the locking arm 146 has a raised position in the direction A where the locking arm teeth 148 are disengaged from the shaft teeth 113 so that the retainer member can move in direction B. The locking arm 146 has a lowered or engaged position where the locking arm teeth 148 are engaged with the shaft teeth 113 so that the retainer member is prevented from moving in the direction B away from the back plate 106.

In some embodiments, the back surface 188 of the protruding portion of the retainer and the back surface 202 of the rear plate 132 may each be concave in the same manner described regarding back surface 109 of the back plate to provide for uniform compressive pressure against the rigid insulation panels 52. Therefore, when the retainer member is locked against the insulation panel(s), the central location of the receiving channel 142 and locking arm 146 lock the back plate against the backup wall surface causing the concave back surfaces 188, 202 to flex and flatten against the insulation panel if sufficient force is applied to the retainer member. This arrangement distributes the load across the insulation panel in the area where the retainer assembly contacts the insulation panel and reduces the chance that the insulation panel will be indented or crushed by the pressure applied to the retainer member. In some embodiments, only the back surface 202 is concave and the back surface 188 is not.

FIGS. 8 through 10 show one application where the tie 100 can be used. After the base(s) 102 is installed on the backup wall 53, insulation panels 52 can be installed between, about, or over the shafts 112 of spaced apart bases, or each row of ties can be installed after placing the underlying row of or adjacent insulation panels 52. The base can be installed after the AB/WRB is installed on the backup wall. Under other methods, the bases 102 can be installed concurrently with the insulation panels 52. The insulation panels 52 are then held in place by installing the retainer assembly 104 on the corresponding shaft 112 of the base until the retainer assembly 104 is in contact with the insulation panel 52. The locking arm 146 engages the shaft in a ratcheting action. The back side of the insulation panels 52 rest against the back plate 106 of the base 102, providing for proper alignment and a small gap 69 between the insulation panel 52 and the back-up wall for drainage. In some applications, a bead of sealant 60, such as polyurethane or silicone sealant can be applied to the top and/or bottom wall of the insulation panels 52 to seal between adjacent panels and around the shaft 112 of the base where adjacent insulation panels 52 join.

Cladding 50 is attached to the backup wall 53 via the ties 100. In some applications, the cladding 50 comprises a plurality of vertically extending panels 50*a*, 50*b*, 50*c*, 50*d*. The panels connect to adjacent panels (50*a*, 50*b*) (50*b*, 50*c*), (50*c*, 50*d*) at panel seams 55*a*, 55*b*, 55*c*, respectively. A cut away view of panels 50*c* and 50*d* are shown in detail in FIG. 10. Each panel comprises a first side wall 57*b*, 59*b* a front wall 57*a*, 59*a*, and a second sidewall 57*c*, 59*c*. The first sidewall 57*b*, 59*b* comprises a cladding connection recess 57*d*, 59*d*. The second side wall 57*c*, 59*c* comprises a cladding connection projection 57*e*, 59*e*.

As shown at panel seam 55*c*, the first side wall 59*b* of panel 59 is adjacent the second side wall 57*c* of the panel 57. The cladding connection projection 57*e* is received in the cladding connection recess 59*d*. A fastener 48 penetrates the cladding connection projection 57*e* into the mount plate 136. In some embodiments the fastener 48 penetrates both the cladding connection recess 59*d* and the cladding connection projection 57*e* at the intersection of the same, and into the mount plate 136. In some applications the fastener 48 may have a low-profile head so as not to interfere with the joining of the cladding connection recess and the cladding connection projection. In some applications, the cladding connection recess is sized to provide a friction fit with the cladding connection projection.

In some applications, the seam 55*c* and the fastener 48 is centered below the shaft 112 of the corresponding tie. In some applications, the seam 55*c* and the fastener 48 is located at any location on the cladding attachment portion 236 of the mount plate 136.

In some applications, the cladding comprises horizontally extending panels, which are joined to the ties with fasteners at the cladding attachment portion 236. In some applications, the cladding comprises a mix of horizontally and vertically extending panels. In some applications, the cladding panels are not attached at a cladding seam, but are instead attached at other locations of the panel such as in the middle or between cladding seams. In some applications, the cladding panels do not have substantial sidewalls, and the cladding panels mount flush against the mount plate 136.

The recess nature of the retainer connection portion 238 of the mount plate 136 allows the retainer member 130 to be recessed behind the rearmost surface of the cladding panels. Therefore, in some applications, the retainer member 130 does not protrude beyond the plane defined by the cladding attachment portion 236 and therefore does not interfere with the mounting and attachment of the cladding panels. Any number of ties may be placed between the cladding and the backup wall depending on the needs of a given application.

The retainer assembly 104 is capable of securing the insulation in place. In addition, the retainer assembly also transfers a portion of the compressive force from the cladding 50, under positive wind or other loads, to the insulation panels 52 via the shaft 112 connection with the cladding wall 50 and the retainer assembly 104. Such loads may also be transferred from the insulation panels to the backup wall 53. This load transfer from the cladding 50 to the insulation and/or the backup wall assist in the prevention of buckling of the shaft where the insulation thickness and/or cavity are large, such as where the cavity is more than 4 inches.

FIGS. 11 through 15 show a second embodiment cladding tie 270. The tie comprises the base 102 of the first embodiment tie 100, and a second embodiment retainer assembly 274. The second embodiment retainer assembly 274 comprises the retainer member 130, the rear plate 132, a second embodiment spacer 276, and a second embodiment cladding connection member 278.

The connection member 278 comprises a vertical arm 280, and a horizontal arm 282. The vertical arm 280 is connected or formed with the horizontal arm at a corner 283. The horizontal arm comprises a first section 284 between a corrugated section 286 and the corner 283. The corrugated section comprises a plurality of ridges 288 and valleys 290. The valleys 290 create lowered portions 294 on a bottom side of the corrugated section. The ridges create recessed portions 292 on the bottom side of the corrugated section. In some embodiments, the distal end of the horizontal arm comprises an end ridge 296 of the plurality of ridges of the corrugated section.

The vertical arm 280 comprises a receiving opening 298 and a pair of lower arms 300, 302. The receiving opening 298 separates the lower arms. The receiving recess comprises a left side wall 304, a top wall 306, and a right side wall 307. The second embodiment spacer 276 comprise a spacer aperture 308, a front surface 309, a left side wall 310, a top wall 312, a right side wall 314, and a bottom wall.

The retainer member 130 and rear plate 132 are rotated ninety degrees clockwise from the position of first embodiment cladding tie 100. The base 102 is also rotated ninety degrees clockwise from the position of first embodiment cladding tie 100.

Figure 13:
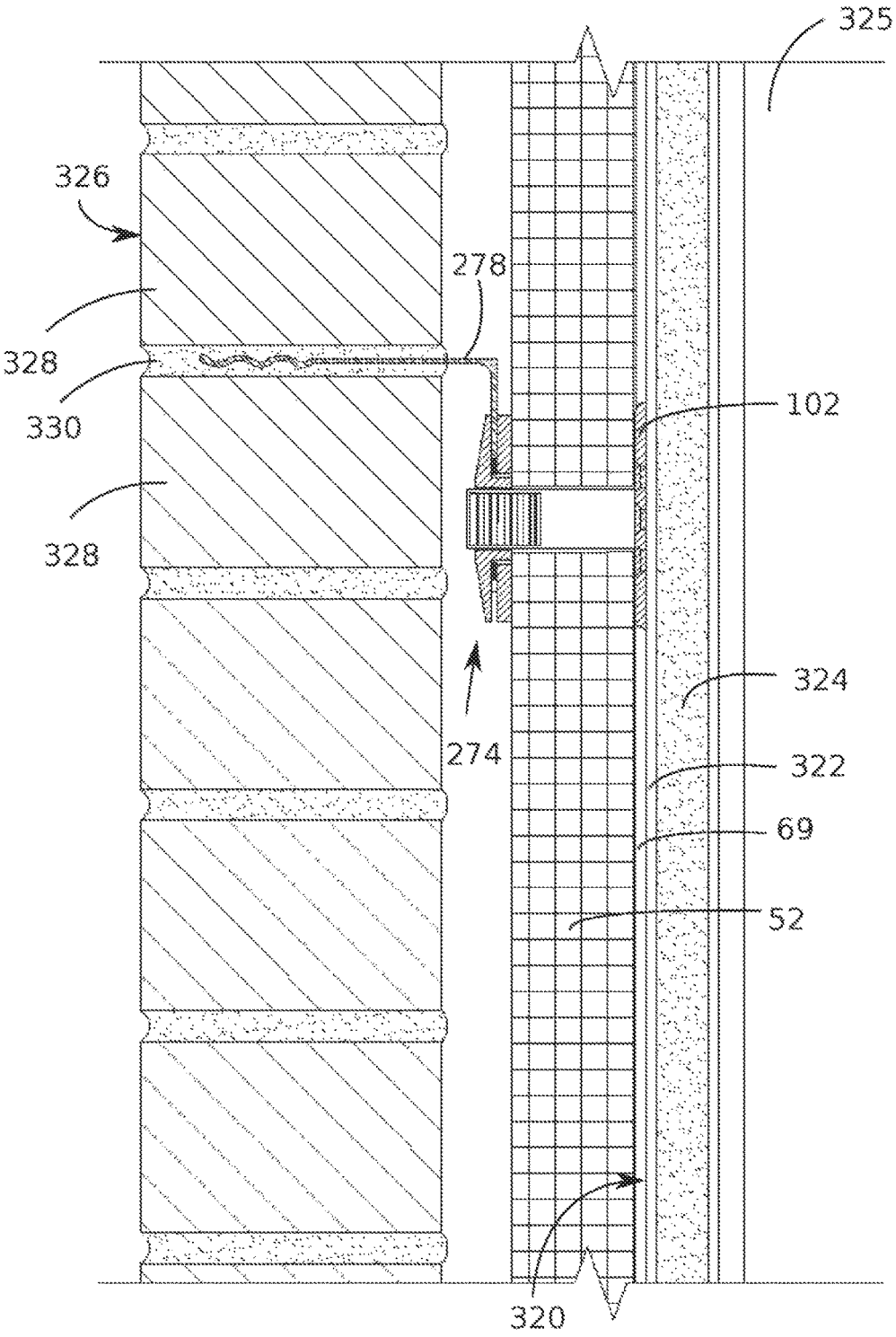
FIG. 13 is a side section view the cladding tie of FIG. 11 shown in a second application.
Figure 14:
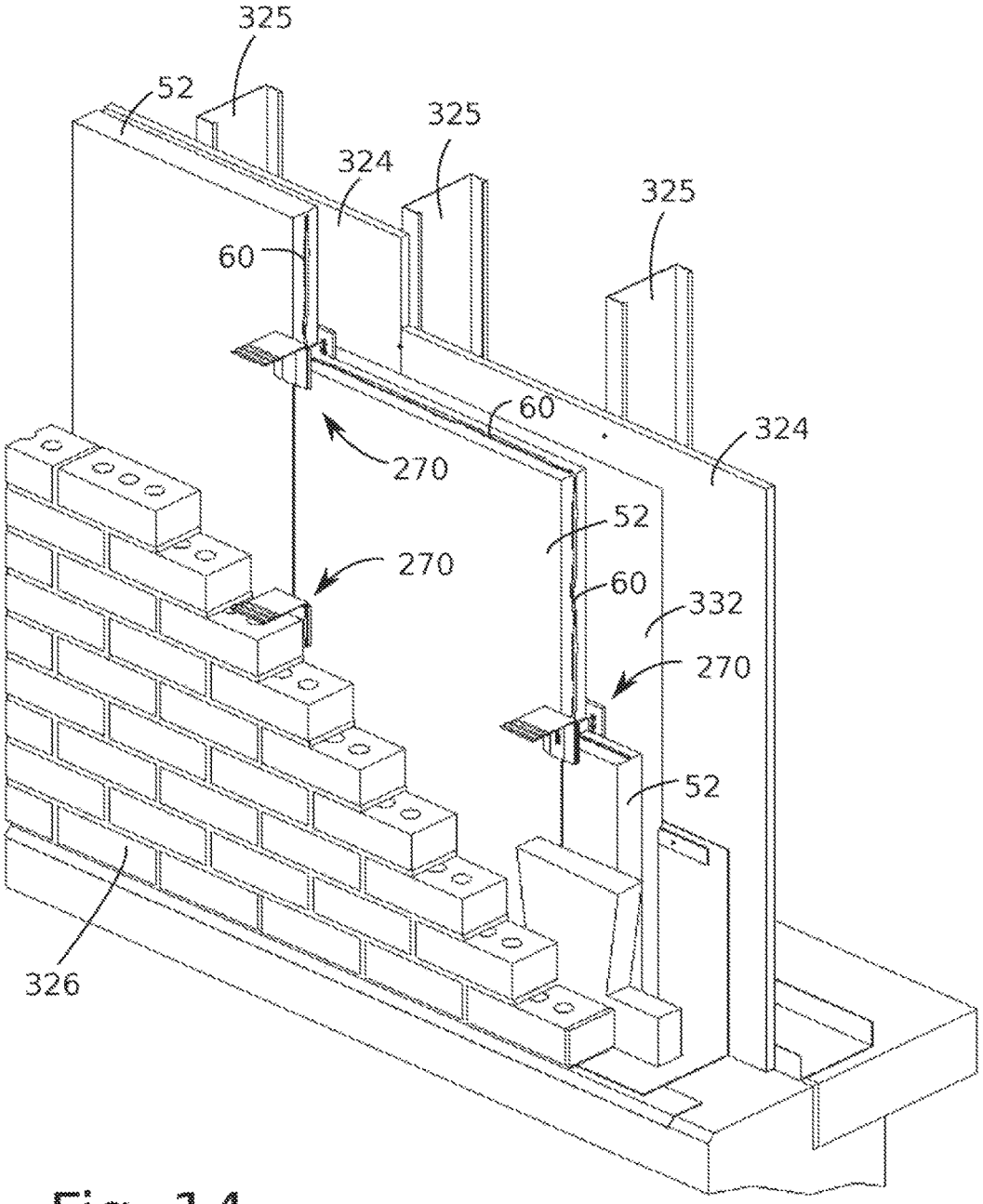
FIG. 14 is a perspective view of the cladding tie shown in the second application of FIG. 13 with certain components of a cladding and a backup wall partially cut away.
Figure 15:
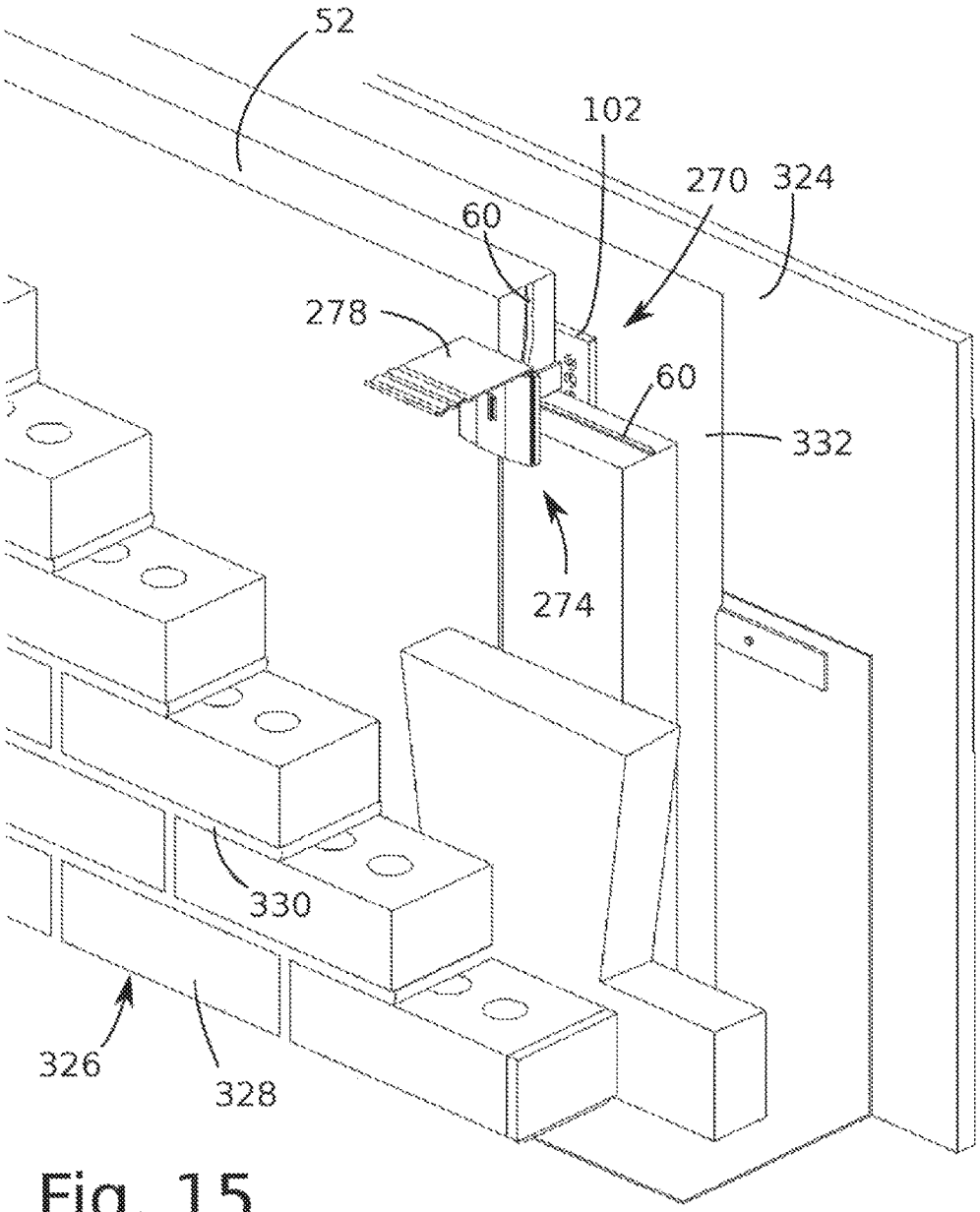
FIG. 15 is an enlarged perspective view of the cladding tie shown in the second application of FIG. 14.

FIGS. 13-15 shows the second embodiment cladding tie 270 deployed in a second cladding application, where the cladding comprises a masonry veneer wall 326. The masonry veneer wall 326 comprises a plurality of masonry bricks or blocks 328 joined at mortar joint(s) 330. The masonry veneer wall 326 is adjacent a backup wall 320. The backup wall 320 comprises an air barrier (AB) and/or weather-resistant barrier (WRB) 322, placed over an exterior wall board 324, placed over wall studs 325. The base 102 may be attached over the air barrier and/or weather-resistant barrier 322.

The base 102 of the tie 270 can be positioned on the backup wall 320 so that the corresponding shaft 112 will be located at a masonry joint 330 or seam. Then the masonry veneer wall 326 can be constructed so that at least a portion, if not all of the corrugated section 286 of the cladding connection member 278 is located in a mortar joint 330 between adjacent bricks or blocks as shown in FIGS. 13-15. In some applications, the entire length of the corrugated section 286 is surrounded by mortar in a mortar joint. In some applications, a portion of the first section 284 together with the corrugated section 286 is located in the mortar joint 330. The ridges 288 and valleys 290 of the corrugated section 286 provide a gripping surface for the mortar to grip and secure the cladding connection member 278 within mortar joint 330.

FIG. 14 shows that the tie 270 may be placed at various locations to secure the masonry veneer wall. Any number of ties, placed at any number of locations, may be used to achieve the desired support for the masonry wall for a given application.

The retainer assembly 274 is joined and provided against insulation panels 52 as shown in FIGS. 13 through 15. The rear plate 132 is placed over the shaft 112 so that the shaft is received through the rear plate aperture 212. The rear plate may be placed against the insulation panel 52. Then the spacer 276 is placed over the shaft 112 so that the shaft is received through the spacer aperture 308. The spacer may be placed against the front surface 200 of the rear plate 132. Then the retainer member 130 is placed over the shaft so that the shaft is received in the receiving channel 142. The spacer 276 and the rear plate 132 are placed over the protruding portion 186. The grooves 214, 216 receive the elongated protrusions 194, 196. The retainer member 130, the spacer 276, and the rear plate 132 are together until the rear plate is against or adjacent the front surface of the insulation panel 52.

Alternatively, the spacer 276 and the rear plate 132 may first be placed over the protruding portion 186 so that the protruding portion 186 is received through the spacer aperture 308 and into the rear plate aperture 212. The sides of the spacer aperture 308 are in contact with the sides of the protruding portion 186. The grooves 214, 216 receive the elongated protrusions 194, 196. And then the retainer member, spacer, and back plate, together as a unit, is placed over the shaft so that that the shaft is received in the receiving channel 142. And the retainer member, spacer, and back plate, together as a unit, are moved adjacent to or in contact the insulation panel.

Figure 12:
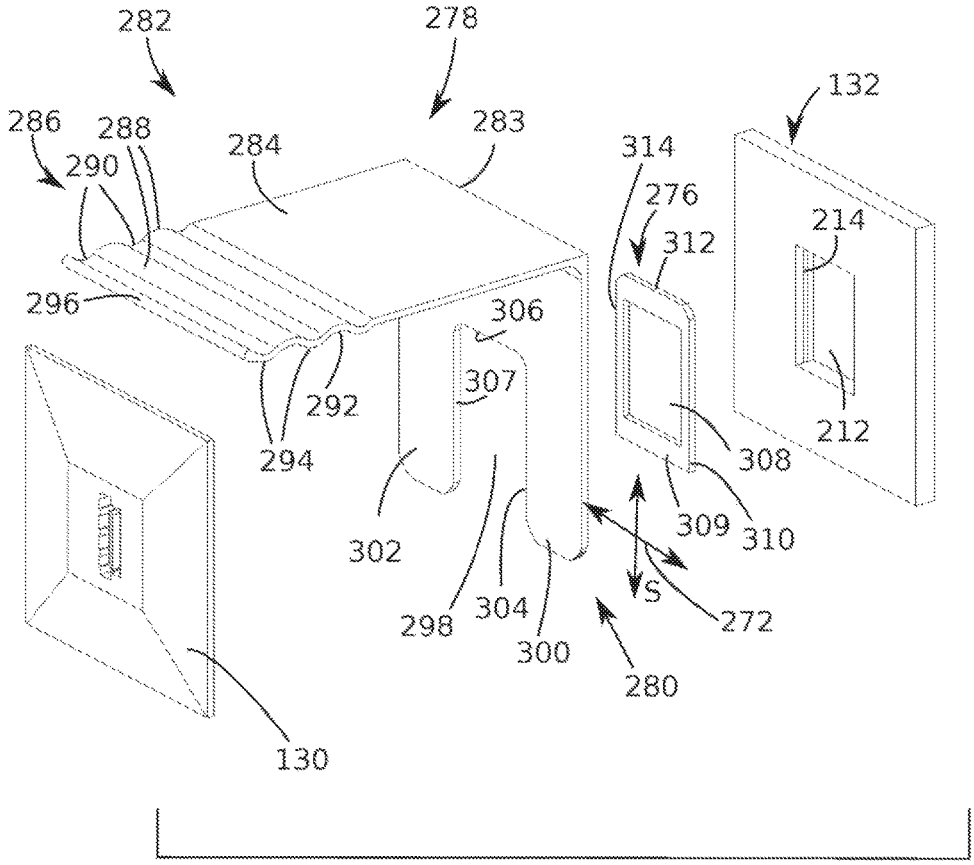
FIG. 12 is an exploded view of a retainer assembly of the cladding tie of FIG. 11.

The cladding connection member 278 is then moved over the spacer 276 and protruding portion 186 of the retainer member 130 in the direction S of FIG. 12 between the first back surface 180 of the retainer member 130 and the front surface 200 of the rear plate 132. The left side wall 310, top wall 312, and right side wall 314 of the spacer 276 are in contact or adjacent the respective corresponding left side wall 304, top wall 306, right side wall 307 of the receiving opening 298. The front surface 309 contacts the back side 186 of the retainer member 130. The bottom surface of the spacer 276 is not in contact with the cladding connection member 278 due to the bottom opening provided by the a receiving opening 298. Therefore there is a bottom side gap (not shown) between the retainer member 130 and the rear plate 132 adjacent the bottom surface of the spacer 276.

In some embodiments, the spacer comprises a flexible or collapsible material, such as insulating foam. The flexible material may be elastic or otherwise returnable to a default expanded state after being compressed when not under a load above a predefined threshold. The flexible material of the spacer automatically centers the cladding connection member 278 about the spacer and protruding portion 186 during installation. This allows ease of installation in that the installer does not need to center the cladding connection member 278 relative to the protruding portion, instead the installer places the cladding connection member 278 in contact with or adjacent to the top wall 312, right side wall 314, and the left side wall 310 of the spacer. The spacer will appropriately position the cladding connection member 278 relative to the protruding portion, the retainer member, and thereby relative to the shaft when the retainer member is mounted to the shaft.

The flexibility or collapsibility of the spacer allows movement of the cladding connection member 278 relative to the shaft 112, the retainer member 130, the rear plate 132, and the spacer 276 in any in-plane direction, such as, in the plane of the slot 199. Likewise, the flexibility of the spacer allows movement of the shaft 112, the retainer member 130, the rear plate 132, and the spacer 134 relative to the cladding connection member 278 in any in-plane direction, such as, in the plane of the slot 199.

Pressure from the cladding connection member 278 or pressure between the cladding connection member 278 and the protruding portion 186 can compress or crush one or more sides of the spacer to allow in-plane movement. Likewise, pressure transferred via the shaft and retainer can cause the one or more sides of the spacer to be compressed or crushed against the cladding connection member 278 or between the cladding connection member 278 and the protruding portion 186. The in-plane movement allowance enabled by the spacer permits differential movement between the cladding 326 and the backup wall 320 without destruction or impartment of the cladding tie, or the cladding system. Four directions, two vertical directions and two horizontal directions, of in-plane movement are illustrated at the compass rose 272. Any intermediate direction of in-plane movement or movement parallel to the cladding, between the four directions illustrated, is also possible. Therefore, any combination of vertical and horizontal moment is possible in-plane. Any movement in-plane is allowed within a predefined range. In one example, the predefined range of movement in a given in-plane direction is defined or limited by the extent and distance that the spacer can be compressed or crushed between cladding connection member 278 and the protruding portion 186.

Sections 181, 182, 184 of the back side 186 of the retainer member 130 contact the front surface of the vertical arm 280. The rear surface of the vertical arm contacts the front surface 200 of the rear plate 132. The rear surface 200 of the rear plate 132 contacts the front surface of the insulation panel 52.

Then the retainer member 130 can be moved further toward the back plate 106 to increase compression on the insulation panel and the connection member 278. In some embodiments and applications, the retainer member 130 provides a friction or compression grip on the cladding connection member 278 by pressure between the retainer member 130 and the rear plate 132 through the insulation panel and the back plate 106. The friction or compression grip prevents the mounting member from becoming disconnected from the retainer assembly 274. The retainer member is engagable and releasable with the shaft in the same manner as described regarding tie 100. The tie 270 may be used in other masonry veneer wall applications, such a veneer walls comprising brick, stone, block, or the like.

In some embodiments and applications, the grip of the retainer on the connection member 278 does not prevent the in-plane movement at the vertical arm 280 of the connection member 278, as explained above, to allow for in-plane differential movement of the masonry wall 326 relative to the backup wall and the shaft. In some embodiments, the retainer does not grip the connection member 278 so as to allow in-plane movement of the connection member 278. In some embodiments, the retainer is adjacent or in surface-to-surface contact with the cladding connection member 278.

FIG. 17 shows a second embodiment retainer member 340. The retainer member 340 is identical to retainer member 130, except as shown in FIG. 17 and described below. The retainer member 340 can be used instead of retainer member 130 in any embodiment or application. The spacers 134, 276 need not be used when the retainer member 340 is used.

The protruding portion 353 of the retainer member 340 comprises a right side 351, a top side 253, a left side 357, and a bottom side 359. Each such side comprises a spring set 346, 350, 348, 352. As each spring set is identical so only spring set 346 will be described. Spring set 346 comprises a first spring 354 and a second spring 356. The first spring is mirror image identical to the second spring about the valley 358. The first spring comprises a peak 360 and a recessed end 362. The peak is farther away from the protruding portion 353 than the valley 358 or the recessed end 362. The recessed end's inward position helps prevent it from binding on the walls of the retainer connection portion 238 or the receiving opening 298 of the connection member 278. Each spring is biased away from the protruding portion, such that when the spring is compressed toward the respective wall of the protruding portion, the spring will create tension biased toward the home, uncompressed position, such as shown in FIG. 17.

The springs achieve the same or similar functions as the flexible or collapsible material of the spacers 134, 276. The springs automatically center the mount plate 136 about the protruding portion 353. This allows ease of installation in that the installer does not need to center the mount plate relative to the protruding portion, instead the installer places the mount plate in contact with or adjacent to the spring sets 350, 346, 348.

The flexibility of springs allow movement of the mount plate 136 relative to the shaft 112, the retainer member 340, and the rear plate 132 in any in-plane direction in the plane of the retainer connection portion 238 between the rear plate 132 and the retainer member 340. Likewise, the flexibility of the springs allow movement of the shaft 112, the retainer member 340, and the rear plate 132 relative to the mount plate 136 in any in-plane direction in the plane of the retainer connection portion 238 between the rear plate 132 and the retainer member 340. Therefore, the mount plate can compress one or more spring about the protruding portion 353 to allow in-plane movement. The in-plane movement allowance enabled by the springs permit differential movement between the cladding 50 and the backup wall 53 without destruction or impartment of the cladding tie.

Likewise, the springs automatically center the cladding connection member 278 about the protruding portion 353. This allows ease of installation in that the installer does not need to center the cladding connection member 278 relative to the protruding portion, instead the installer places the cladding connection member 278 in contact with or adjacent to the spring sets 346, 350, 348. The springs allow movement of the cladding connection member 278 relative to the shaft 112, the retainer member 130, and the rear plate 132, in any in-plane direction in the plane of the vertical arm 280 between the rear plate 132 and the retainer member 340. Likewise, the springs allow movement of the shaft 112, the retainer member 130, and the rear plate 132 relative to the cladding connection member 278 in any in-plane direction in the plane of vertical arm 280 between the rear plate 132 and the retainer member 340. Therefore, the cladding connection member 278 can compress one or more springs about the protruding portion 353 to allow in-plane movement. The in-plane movement allowance enabled by the springs permit differential movement between the cladding 236 and the backup wall 320 without destruction or impairment of the cladding tie.

While FIG. 17 shows two spring per side of the protruding portion, in some embodiments, one spring or more than two springs are provided on each side. In some embodiments, springs are provided on less than all four sides of the protruding portion. For example, springs might be omitted from the side that is not in contact or adjacent to a surface 256, 258, 260 of the receiving opening 240, or a wall 304, 304, 307 of receiving opening 298.

Figure 11:
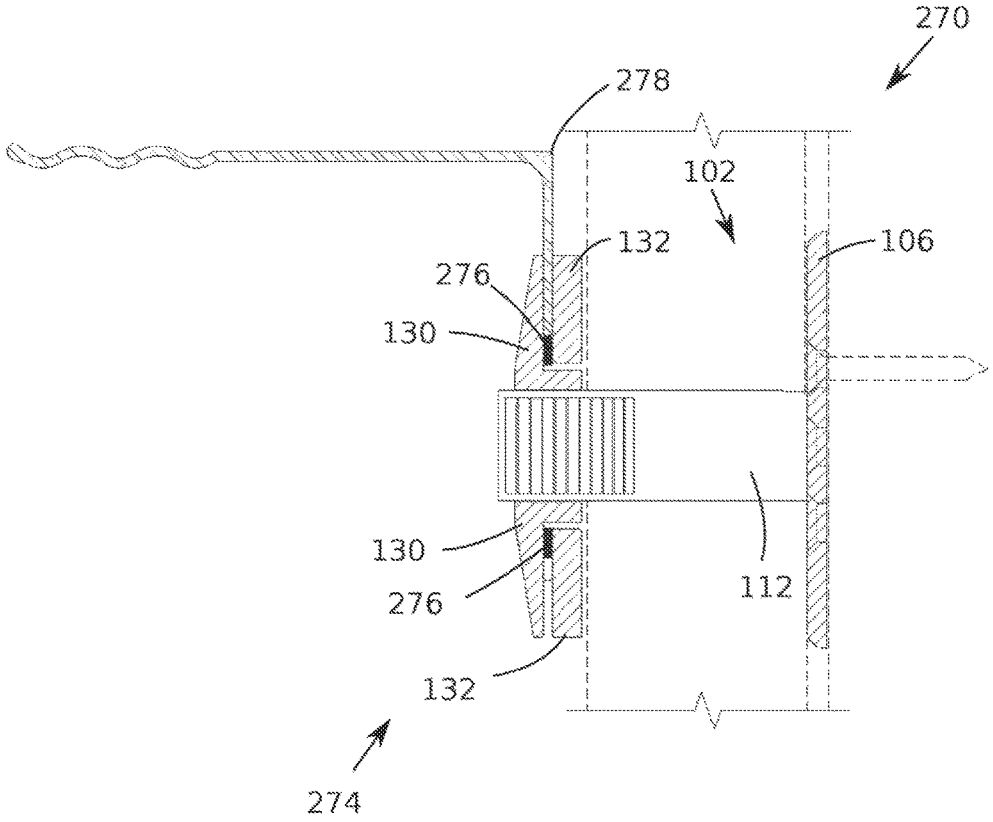
FIG. 11 is a side sectional view of a second embodiment cladding tie of the invention.

In some embodiments, the rear plate 132 is integrally formed as one unit with the retainer member 130 at the protruding portion 186 in the position shown in FIG. 1 or 11. In some embodiments, the spring sets 346, 348, 350, 352 or spacer 134 are also integrally formed with or adhered to the protruding portion 186 of the retainer member 130. In such embodiments, the retainer member comprises the insulation contact plate and the spacer or spring sets. A recess or slot, such as recess or slot 199, between the rear plate 132 and the first back surface 180 of the retainer member 130 is where the retainer connection portion 238 of the mount plate 136 or the vertical arm 280 of the connection member 278 is received in the same manner as shown in FIG. 1, 6 or 11.

While cladding connection members 136 and 278 are shown, it will be appreciated that other types and shapes of members for connecting cladding to the retainer member can be used.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A cladding attachment device for providing a support connection between a vertical cladding wall and a vertical backup wall, comprising:

a base comprising a shaft and a back plate, the shaft extending from the back plate, the shaft comprising a plurality of shaft teeth, the shaft is permanently connected to the back plate;

a cladding connection member comprising a cladding engagement portion and a retainer engagement portion, the cladding engagement portion comprises a plurality of corrugations for interlocking with a mortar of a masonry joint of the vertical cladding wall, the cladding engagement portion is transverse to the retainer engagement portion;

a retainer comprising an insulation contact surface, a receiving channel, a cladding connection member recess, and a locking arm, the receiving channel comprising a receiving entrance on the insulation contact surface, the receiving channel extending transversely through the insulation contact surface and configured to receive the shaft, the locking arm is adjacent the receiving channel, the locking arm is biased to a locked position where the locking arm engages at least one of the plurality of shaft teeth when the at least one of the plurality of shaft teeth is adjacent the locking arm to prevent the retainer from moving in a first direction away from the back plate, the retainer engagement portion is moveable within the cladding connection member recess to permit differential movement between the cladding connection member and the retainer when the cladding connection member is connected to the retainer;

the retainer is configured to hold an insulation panel against the back plate when the retainer in a holding position along the shaft and the locking arm is in the locked position.

2. The device of claim 1, wherein the locking arm comprises a released position and the locked position, the locking arm is released from the plurality of shaft teeth and the retainer is free to move in two directions along the shaft when the locking arm is in the released position.

3. The device of claim 1, wherein the locking arm comprises a plurality of locking arm teeth that engage with the plurality of shaft teeth of the shaft to prevent the retainer from moving away from the back plate.

4. The device of claim 1, comprising a resilient biasing member, the biasing member is located in the cladding connection member recess to buffer contact between the cladding connection member and the retainer, the biasing member biases the cladding connection member a home position relative to the retainer.

5. The device of claim 1, wherein the back plate comprises a back surface, the back surface is concave.

6. The device of claim 1, wherein the retainer comprises a cladding connection member contact surface and a rear protrusion, the rear protrusion extends beyond the cladding connection member contact surface, the rear protrusion comprises a rear insulation contact surface, and the rear insulation contact surface is configured to contact the insulation panel when the retainer is in the holding position.

7. The device of claim 6, the retainer comprises an insulation contact plate, the insulation contact plate comprises a passage, a front surface, and a back surface, the passage extends through the insulation contact plate from the front surface to the back surface;

the insulation contact plate forming at least one wall of the cladding connection member recess;

the back surface of the insulation contact plate surface holds the insulation panel against the back plate when the retainer in the holding position;

the passage of the insulation contact plate is sized to receive the rear protrusion of the retainer.

8. The device of claim 6, wherein the receiving channel exits the retainer through an opening in the rear insulation contact surface of the retainer.

9. The device of claim 1, the retainer comprises an insulation contact plate, the insulation contact plate comprising a passage, a front surface, and a back surface, the passage extends through the insulation contact plate from the front surface to the back surface;

the insulation contact plate forming at least one wall of the cladding connection member recess;

the back surface holds the insulation panel against the back plate when the retainer in the holding position.

10. The device of claim 1, wherein the retainer engagement portion of the cladding connection member extends above and below the shaft.

11. The device of claim 1, where the retainer engagement portion surrounds at least three sides of the shaft when in a held position when connected to the retainer.

12. The device of claim 8, wherein the retainer engagement portion surrounds at least three sides of the rear protrusion of the retainer when connected to the retainer.

13. The device of claim 8, comprising a resilient spacer, the resilient spacer is located in the cladding connection member recess to buffer contact between the cladding connection member and the retainer.

14. The device of claim 1, wherein the cladding connection member recess is a slot, the slot permits movement of the retainer engagement portion relative to the retainer in a plane of the slot.

15. The device of claim 1, wherein the retainer comprises a rear protrusion, the rear protrusion comprises a rear insulation contact surface, and the rear insulation contact surface is configured to contact the insulation panel when the retainer is in the holding position; and the retainer engagement portion comprises an opening and two lower arms, the opening separates the two lower arms, and the rear protrusion is configured to be received through the opening when the retainer engagement portion is located in the cladding connection member recess.

16. The device of claim 15, comprising a compressible spacer, the spacer is located in the cladding connection member recess to buffer contact between the cladding connection member and the retainer, the spacer biasing the cladding connection member a home position about the retainer.

17. A cladding attachment device for providing a support connection between a vertical cladding wall and a vertical backup wall, comprising:

a base comprising a shaft and a back plate, the shaft extending from the back plate, the shaft comprising a plurality of shaft teeth, the shaft is permanently connected to the back plate;

a cladding connection member comprises a vertical arm and a horizontal arm, the horizontal arm comprises a plurality of corrugations for interlocking with a mortar of a masonry joint of the vertical cladding wall;

a retainer comprising an insulation contact surface, a receiving channel, a cladding connection member recess, and a locking arm, the receiving channel comprising a receiving entrance on the insulation contact surface, the receiving channel extending transversely through the insulation contact surface and configured to receive the shaft, the locking arm is adjacent the receiving channel, the locking arm is biased to a locked position where the locking arm engages at least one of the plurality of shaft teeth when the at least one of the plurality of shaft teeth is adjacent the locking arm to prevent the retainer from moving in a first direction away from the back plate, the vertical arm is moveable within the cladding connection member recess to permit differential movement between the cladding connection member and the retainer when the cladding connection member is connected to the retainer, the retainer is configured to hold an insulation panel against the back plate when the retainer in a holding position along the shaft and the locking arm is in the locked position.

18. The device of claim 17, wherein the cladding connection member recess is a slot, the slot permits movement of the vertical arm relative to the retainer in a plane of the slot; retainer comprises a rear protrusion; and the vertical arm surrounds at least three sides of the rear protrusion of the retainer when connected to the retainer.

19. A cladding tie for providing a support connection between a vertical cladding and a vertical backup wall, comprising:

a base comprising an elongated member and a mounting plate, the elongated member extending from the mounting plate, the elongated member comprising a plurality of elongated member teeth, the elongated member is permanently connected to the mounting plate;

a retainer assembly comprising a cladding connection member, and a retainer member;

the cladding connection member comprises a cladding attachment portion, a retainer contact portion, and an aperture, the cladding attachment portion configured for interlocking engagement with a mortar of a masonry joint of the vertical cladding;

the retainer member comprising an insulation contact surface, a receiving channel, a rear protruding portion, a resilient biasing member, and a locking arm, the receiving channel comprising a receiving entrance on the insulation contact surface, the receiving channel extending transversely through the insulation contact surface and configured to receive the elongated member, the locking arm is adjacent the receiving channel, the locking arm is biased to a locked position where the locking arm engages at least one of the plurality of elongated member teeth when the at least one of the plurality of elongated member teeth is adjacent the locking arm to prevent the retainer member from moving in a first direction away from the mounting plate, the biasing member extends from the rear protruding portion, the biasing member engageable with a perimeter of the aperture to align the cladding connection member relative to the retainer member;

the retainer contact portion is moveable within the receiving channel to permit differential movement between the cladding connection member and the retainer when the cladding connection member is connected to the retainer the retainer assembly configured to hold an insulation panel against the mounting plate when the retainer member in a holding position along the elongated member.

20. The tie of claim 19, wherein the biasing member comprises a spring.

21. The tie of claim 19, wherein the biasing member is a spacer, the spacer comprises a compressible resilient material.

22. The tie of claim 19, wherein the biasing member extends from at least three sides of the rear protruding portion.

* * * * *